US006568083B1

(12) United States Patent
Taniguchi et al.

(10) Patent No.: US 6,568,083 B1
(45) Date of Patent: May 27, 2003

(54) DRY SHAVER WITH A HEIGHT ADJUSTABLE CUTTER HEAD

(75) Inventors: Fumio Taniguchi, Hikone (JP); Toshiyuki Tsushio, Hikone (JP); Yasunori Ueda, Hikone (JP); Masanobu Yamasaki, Hikone (JP); Takeshi Shiba, Hikone (JP); Jyuzaemon Iwasaki, Nagahama (JP); Mitsuhiro Kadowaki, Tsu (JP); Hirokazu Kato, Hikone (JP); Mikihiro Yamashita, Echi-gun (JP); Yasuo Ibuki, Hikone (JP); Atsushi Takahashi, Nagaokakyo (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/869,304

(22) PCT Filed: Nov. 24, 2000

(86) PCT No.: PCT/JP00/08287

§ 371 (c)(1),
(2), (4) Date: Jul. 19, 2001

(87) PCT Pub. No.: WO01/38052

PCT Pub. Date: May 31, 2001

(30) Foreign Application Priority Data

| | | |
|---|---|---|
| Nov. 25, 1999 | (JP) | 11-335084 |
| May 26, 2000 | (JP) | 2000-157275 |
| May 26, 2000 | (JP) | 2000-157459 |
| May 26, 2000 | (JP) | 2000-157460 |

(51) Int. Cl.[7] ..... B26B 19/10

(52) U.S. Cl. ..... 30/43.2; 30/43.1; 30/43.6; 30/43.92

(58) Field of Search ..... 30/43.92, 43.91, 30/43.9, 43.6, 346.51, 43.1, 43.2

(56) References Cited

U.S. PATENT DOCUMENTS

| | | | | |
|---|---|---|---|---|
| 3,913,225 A | * | 10/1975 | Tietjens et al. | 30/43.6 |
| 4,085,503 A | * | 4/1978 | Beck et al. | 30/43.92 |
| 5,398,412 A | | 3/1995 | Tanahashi et al. | 30/43.92 |
| 5,459,927 A | * | 10/1995 | Kauer et al. | 30/43.1 |
| 5,687,481 A | | 11/1997 | De Boer et al. | 30/43.1 |

FOREIGN PATENT DOCUMENTS

| | | |
|---|---|---|
| EP | 0 329 244 | 8/1989 |
| JP | 60-176679 | 9/1985 |

* cited by examiner

*Primary Examiner*—Hwei-Siu Payer
(74) *Attorney, Agent, or Firm*—Oblon, Spivak, McClelland, Maier & Neustadt, P.C.

(57) ABSTRACT

A dry shaver is capable of being depressed equally at different positions but with differing contact pressures between outer and inner cutters. The shaver has a housing having a motor and inner and outer cutters at its upper end. The inner cutter is driven by the motor to move in shearing engagement with the outer cutter for shaving hairs. The inner cutter is urged upwardly by a bias spring to develop a contact pressure against the outer cutter. The outer cutter is carried by a cutter holder movably supported to a head frame mounted on top of the housing. The shaver has a height adjust mechanism for adjusting the height of the head frame relative to the housing between a high position and a low position while compressing the spring differently to vary the contact pressure, and for allowing the cutter holder to be depressed relative to the head frame from each of the height and low positions.

38 Claims, 22 Drawing Sheets

35
112
114
116
110
111
121
120

35
112
114
116
110
111
121
120

35
112
114
116
110
111
121
120

80B
30B
42B
130B
134B
140
34B
135B
36B
10B
25B
100B 38
37
30C
10C

DRY SHAVER WITH A HEIGHT ADJUSTABLE CUTTER HEAD

TECHNICAL FIELD

The present invention relates to a dry shaver with a height adjustable cutter head, and more particularly to the shaver having a floating cutter head which is capable of being depressed equally at different positions but against differing biasing forces.

BACKGROUND ART

A shaver with a floating cutter head is known in the art, for example, in U.S. Pat. No. 5,398,412 to be advantageous for making it easy to move the cutter head in smooth contact with various portions of a user's face for effective shaving. The cutter head comprises a head frame which carries an outer cutter and is mounted on top of a shaver housing. An inner cutter is urged by a bias spring into pressed contact with the outer cutter and is driven to move relative to the outer cutter for shearing the hairs. The head frame is floatingly supported to the shaver housing so that the cutter head can be depressed while compressing the bias spring. Thus, the biasing force of the spring increases as the cutter head is depressed. When the user intends to shave the hard hairs, the cutter head is depressed deeply to increase the biasing force, i.e., the contact pressure between the outer cutter and the inner cutter for successfully shearing the hard hairs with the increased contact pressure. The deeper the cutter head is depressed to increase the contact pressure, the more the skin experiences a counter-pressure from the outer cutter. The counter-pressure is inevitable for the shaving, but should be kept within a tolerable range since too-much counter-pressure can irritate the skin. However, when shaving the hard hairs with the floatingly supported cutter head of the above patent, the cutter head has to be depressed deeply with an attendant increase in the counter-pressure. In other words, the shaving of the hard hairs is made only after the cutter head is depressed deeply at the sacrifice of the increased counter-pressure, while the shaving of the soft hairs can be made even without depressing the cutter head and therefore only at a slight counter-pressure to the skin. Consequently, in order to reduce the skin irritation, it is highly desirable that the cutter head gives a reduced counter-pressure to the skin even for shaving the hard hairs with the increased contact pressure between the outer and inner cutters.

In the meanwhile, Japanese Patent Early Publication (KOKAI) No. 60-176679 discloses one solution of adjusting the contact pressure between the outer cutter and the inner cutter. The outer cutter is fixedly mounted on top of a shaver housing, while the inner cutter is urged by a bias spring against the outer cutter. The bias spring is supported to a drive element for the inner cutter and is compressed between the inner cutter and the drive element for giving a suitable contact pressure between the outer cutter and the inner cutter. The contact pressure is adjusted by varying a compression amount of the bias spring with the outer cutter being kept in a fixed position. Since the outer cutter is not capable of being depressed in a direction of varying the compression amount of the bias spring, the contact pressure has to be adjusted by use of an actuator which is connected to the bias spring or to the drive element for directly deforming the bias spring or moving the drive element of the inner cutter towards and away from the outer cutter. The actuator moves together with the drive element, i.e., the inner cutter and therefore gives rise to a considerable friction with a handle mounted on the shaver housing for manipulation of the actuator, thereby inevitably developing an additional friction at the interconnection between the moving actuator and the handle, which should be avoided for reducing noise and power consumption.

DISCLOSURE OF THE INVENTION

The present invention has been accomplished in view of the above insufficiency to provide an improved dry shaver which is capable of being depressed equally at different positions but with differing contact pressures between the outer and inner cutters. The shaver in accordance with the present invention comprises a housing having a motor and mounting the outer cutter and the inner cutter at its upper end. The inner cutter is driven by the motor to move in shearing engagement with the outer cutter for shaving the hairs. The inner cutter is urged upwardly by a bias spring to develop a contact pressure at which the inner cutter is pressed against the outer cutter. The outer cutter is carried by a cutter holder which is movably supported to a head frame mounted on top of the housing. Included in the shaver is a height adjust mechanism for adjusting the height of the head frame relative to the housing between a high position and a low position while compressing the bias spring differently to vary the contact pressure, and for allowing the cutter holder to be depressed relative to the head frame at each of the high and low positions. Therefore, in addition to that the outer cutter can be depressed further even at the low position when shaving the hard hairs, the hard hair shaving can be initiated at the low position where the increased contact pressure is available but with the outer cutter being held undepressed relative to the head frame, and therefore without exerting the increased counter-pressure to the skin, thereby enabling to shave the hard hairs successfully with the increased contact pressure but without irritating the skin. Stating differently, the increased contact pressure effective for shaving the hard hairs can be initially set without depressing the outer cutter which would otherwise increase the counter-pressure on the skin. Shaving of soft hairs can be made with the head frame held at the high position where the outer cutter is allowed to follow the contour of the skin only accompanied with less counter-pressure on the skin and where the contact pressure is low but sufficient for shaving the soft hairs.

Accordingly, it is a primary object of the present invention to provide an improved dry shaver which is capable of shaving the hard hairs successfully and easily in a like manner as shaving the soft hairs.

Preferably, the head frame has a head cover projecting on top of the housing to surround the outer cutter in such a way that the outer cutter exposed on the head cover. The height adjust mechanism is interlocked with the head cover so as to move he head cover together with the head frame between the high and low positions. Thus, the outer cutter is kept exposed on the head cover equally irrespective of the high and low position that the head frame takes, assuring convenient shaving of the hairs while varying the contact pressure.

The inner cutter is driven to move by a drive element projecting on top of the housing. It is this drive element that mounts the bias spring with one end of the spring retained to the drive element and with the other end of the spring being held in pressed contact against the inner cutter, developing the contact pressure between the outer and inner cutters. Thus, as the outer cutter, i.e., the head frame is depressed deeper, the contact pressure will increase for facilitating the shaving of the hard hairs.

In a preferred embodiment, the height adjust mechanism comprises a handle and a slider which is actuated by the handle to vertically move the head frame. The slider has an upper end projecting on top of the housing for detachable engagement with the head frame, enabling the head frame to be removed from the housing for cleaning of the shaver.

The housing is formed on its top wall with a fixed mount frame for detachably mounting the head frame. The mount frame has a peripheral wall projecting on top of the housing in an overlapping relation with the head frame along the entire periphery of the housing irrespective of the position of the head frame relative to the housing. With this arrangement, it is readily possible to retain the sheared hairs within the confines of the top periphery of the housing and prevent undesired scattering of the hairs outwardly through the interface between the head frame and the housing.

The housing may be composed of a main case and a front cover. The main case has a water-tightly sealed interior space for accommodating the motor and carries the drive element extending in a water-tight fashion from the motor through a top of the main case for driving connection with the inner cutter. The front cover is placed over the main case to form therebetween a compartment which is separated from the water-tight sealed interior space. The handle is partly disposed in the compartment and is exposed on the exterior of the front cover. The slider is movably supported to the main case exteriorly of the water-tight sealed interior space to have its one end connected to the handle and the other end connected to the head frame. Thus, the height adjusting mechanism composed of the handle and the slider can be isolated from the sealed space and therefore can be added to the shaver while keeping water-tight sealing of the motor and associated electrical parts.

The handle is preferably realized as a dial rotatably mounted on the housing to translate the rotary motion of the dial into the vertical movement of the slider. The slider may be provided with a rack which is in meshing engagement with a gear of the dial.

A latch may be provided to engage with the dial in order to hold the head frame at the high and low positions, as well as an intermediate position.

The housing may be provided with an additional motor for driving the slider to move vertically when adjusting the position of the head frame.

Preferably, the slider is formed at its upper end with a hook for detachable engagement with the head frame and at its lower end with a joint for engagement with the dial. The dial is fixed to the housing with respect to a vertical direction in which the head frame is allowed to move. The slider has a resilient leg connecting the hook and the joint so as to permit the head frame engaged with the hook to resiliently move in the vertical direction relative to the housing. With this arrangement, the resilient leg can absorb an impact possibly applied to the head frame when the shaver is dropped on the floor, thereby protecting the outer cutter as well as the height adjusting mechanism.

In this connection, the shaver is provided with a restrictor which restricts an extent to which the head frame is permitted to resiliently move relative to the housing. The restrictor comprises a rigid guide which is actuated by the dial to move vertically together with the slider and which is formed with a vertically elongated slot for loosely receiving a stud formed on the slider between the hook and the resilient leg. The stud is engaged with the slot such that the stud is only allowed to move vertically within the slot for restricting the resilient movement of the head frame. Preferably, the slider is formed as a single piece to have the resilient leg integrally formed with the hook and the joint.

In the preferred embodiment, the dial is rotatably supported to the housing to rotate about a rotary axis and is formed with a cam groove for engagement with a cam follower projecting on the slider. The cam groove is made eccentric with respect to the rotary axis so as to translate the rotary motion of the dial into the vertical movement of the slider. The cam groove may be an endless annular groove extending about the rotary axis so that the dial can be rotated continuously in either direction for adjusting the height of the head frame. The cam groove is preferred to have a curvature varying along its path from a minimum curvature to a maximum curvature. The cam groove is engaged with the cam follower at a portion having the minimum curvature when the slider moves the head frame just around the low position. In this consequence, the cam follower travels less distance with respect to a radial direction of the dial per unit angular movement thereof, thereby enabling to manipulate the dial softly but sufficiently against the increased force due to the depressed bias spring when the head frame is around the low position.

The dial is preferably located closer to the head frame than a power switch mounted on front of the housing so that the dial can be easily accessed by a thumb of a user's hand grasping the housing for control of the height of the head frame immediately after manipulating the power switch by the thumb. In this connection, the dial is located centrally of the housing with respect to a width dimension of the housing so that both of the left-handed and right-handed user can equally and easily manipulate the dial. The dial is preferred to include an indication for indicating the height of the head frame for easy confirmation by the user.

Further, the shaver may include a speed controller which varies a speed of the inner cutter in accordance with varying height of the head frame relative to the housing. More particularly, the speed controller is configured to increase the speed of the inner cutter as the head frame is lowered to the low position where the inner cutter is pressed against with increased contact pressure for shearing the hard hairs, thereby assuring successful shearing of the hard hairs with increased speed of the inner cutter.

The speed controller may comprise a position sensor for sensing the height of the head frame and a current-regulator which varies an electric current being supplied to the motor in accordance with an output of the position sensor.

When the inner cutter is driven to reciprocate relative to the outer cutter, the speed controller may be configured to vary a reciprocation amplitude of the inner cutter for varying the speed of the inner cutter. When the inner cutter is driven to rotate relative to the outer cutter, the speed controller is configured to vary a rotation speed of the inner cutter.

Alternatively, the shaver may include a controller which keeps the speed of the inner cutter constant irrespective of the varying height of the head frame.

In another preferred embodiment, the head frame is supported to a sleeve to be vertically movable relative to the sleeve. The sleeve is detachably mounted to an upper end of the housing and carries the height adjusting mechanism which varies the height of the head frame relative to the sleeve and includes a handle. Therefore, the height adjust mechanism can be assembled into a unit separate from the housing and can be therefore easily combined to the housing without causing any substantial interference with the structure of the housing, for example, the water-tight seal given to the housing for sealing the electric parts within the housing.

The head frame may be mounted to an additional support frame and is made vertically movable together therewith relative to the sleeve for height adjustment of the head frame. In this instance, the head frame surrounds the outer cutter to define itself the head cover which is movable together with the support frame.

The housing is closed at its upper end with a top member and is provided with the drive element projecting through the top member for driving connection with the inner cutter. The support frame is cooperative with the sleeve to form a barrier which surrounds the entire periphery of the top member irrespective of the position of the head frame relative to the housing. Thus formed barrier can well retain the sheared hairs on top of the housing and prevent undesired scattering of the hairs outwardly of the housing.

The handle mounted on the sleeve is configured to travel a path for adjusting the head frame between the high and low positions, which path is made longer than a vertical distance of the head frame between the high and low positions for enabling the height adjustment with a light operating force.

Associated with the handle is a click member which gives a click resistance to the handle movement. The click member is provided to develop the click resistance which is smaller when lowering the head frame from the high position to the low position than raising the head frame from the low position to the high position. Therefore, the small clicking resistance is added to the increasing downward spring force of the bias spring when the head frame is manipulated to move towards the low position, while the large clicking resistance is reduced by the upward spring force when the head frame is moving toward the high position. With this result, it is possible to manipulate the handle with a nearly equal operating force either when raising or lowering the head frame.

The support frame may have a stopper which engages with the sleeve so as to prevent an unintentional detachment of the support frame and the head frame from the sleeve.

These and still other advantageous features of the present invention will become more apparent from the following detailed description of the preferred embodiments when taken in conjunction with the attached drawings.

MODES FOR CARRYING OUT THE INVENTION

First Embodiment <FIGS. 1 to 10>

Figure 1:
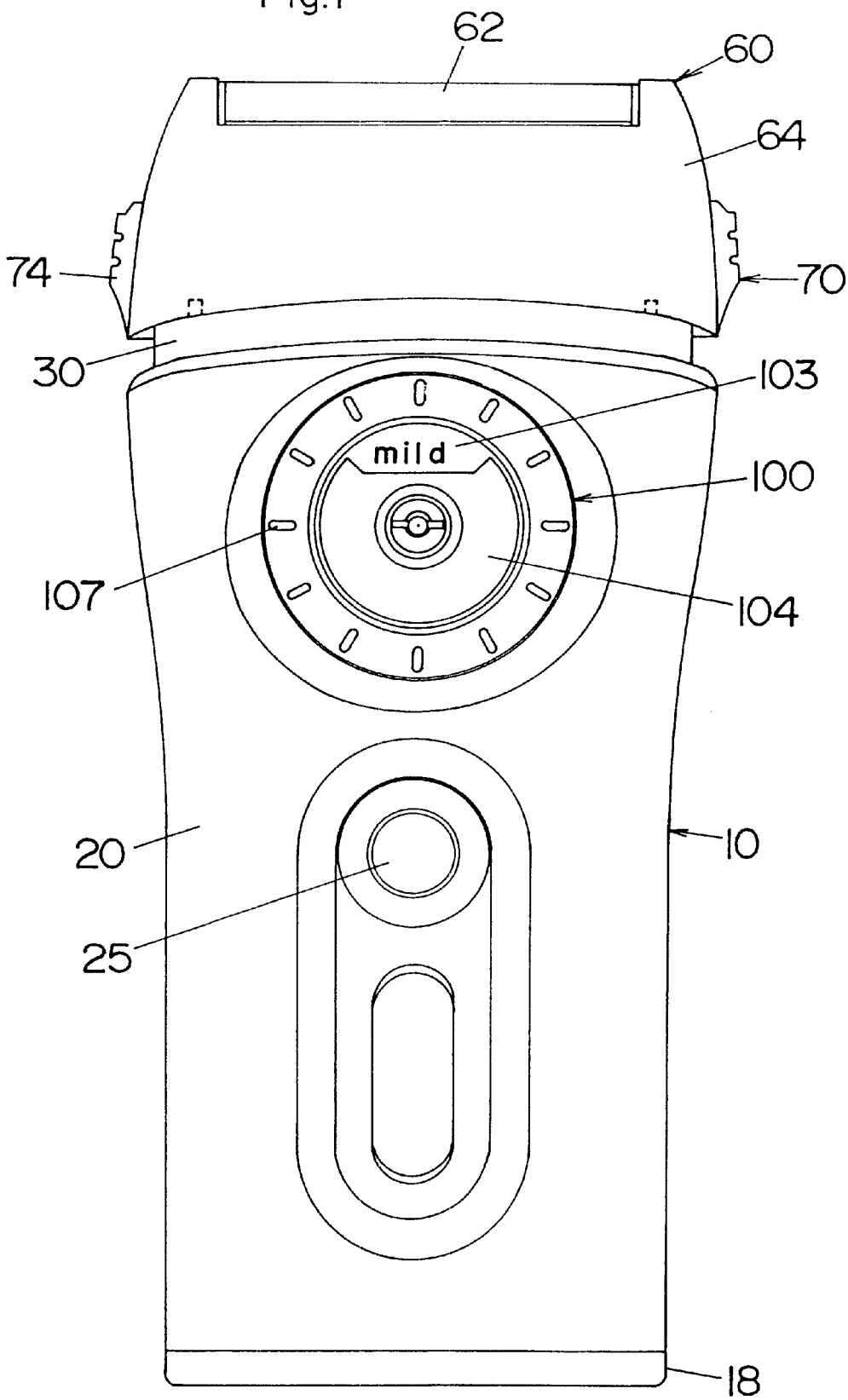
FIG. 1 is a front view of a dry shaver in accordance with a first embodiment of the present invention.

Referring now to FIGS. 1 to 4, there is shown a dry shaver in accordance with a first embodiment of the present invention. The shaver comprises a vertically elongated housing 10 and a cutter head 60 detachably mounted on top of the housing 10. The housing 10 accommodates therein a motor 40, a rechargeable battery energizing the motor, and associated electrical parts. The motor 40 is a linear reciprocating motor having two reciprocators carrying drive elements 42 which project on top of the housing 10 and are connected respectively to inner cutters 61 for reciprocating the same.

Figure 4A:
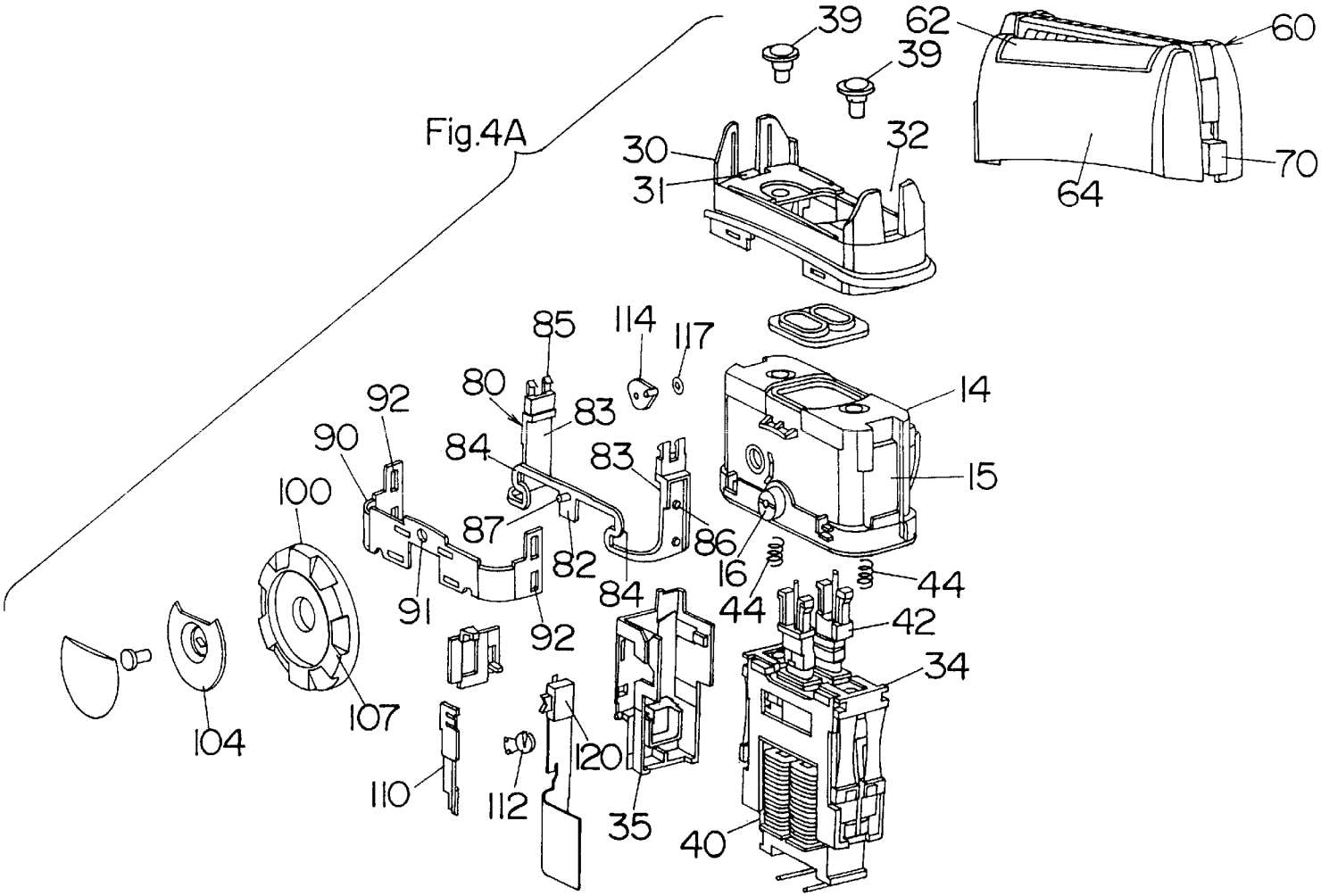
FIG. 4, composed of FIGS. 4A and 4B, is an exploded perspective view of the shaver.
Figure 4B:
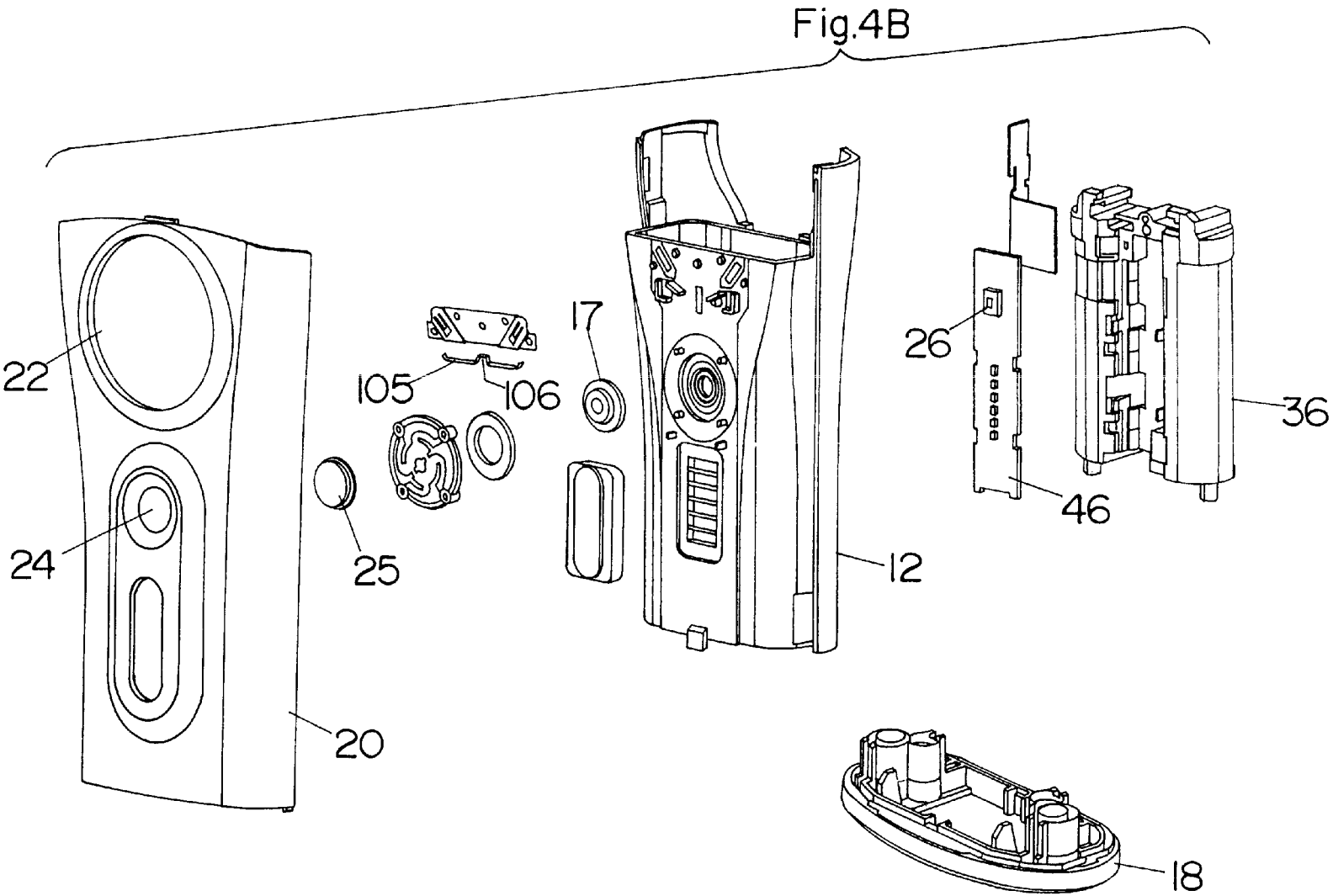

The housing 10 comprises a main case and a front cover 20, as shown in FIGS. 4A and 4B. The main case is composed of a tube 12, the upper shell 14 and a bottom cover 18. The upper shell 14 and the bottom cover 18 close the top and bottom openings of the tube 12, respectively in a water-tight fashion to seal the motor 40 and the associated electrical parts within the main case. A mount frame 30 is placed on top of the upper shell 14 for mounting the cutter head 60. The motor 40 is held in an upper chassis 34 which is partly received in the upper shell 14 to project the drive elements 42 upwardly through the top of the upper shell 14 and through the mount frame 30. The upper chassis 34 are secured to a lower chassis 36 which carries the battery, a circuit board 46 forming a control circuit of driving the motor, and a coil 48 forming a charging circuit of the battery. The mount frame 30 and the upper shell 14 are secured commonly to the upper shell 14 by means of screws 39, and the bottom cover 15 is secured to the lower chassis 36 also by means of screws. Whereby, the upper shell 14 and the bottom cover 18 are secured to the tube 12 with suitable sealing rings interposed at the interfaces to form a water-tight sealed main case.

Figure 5:
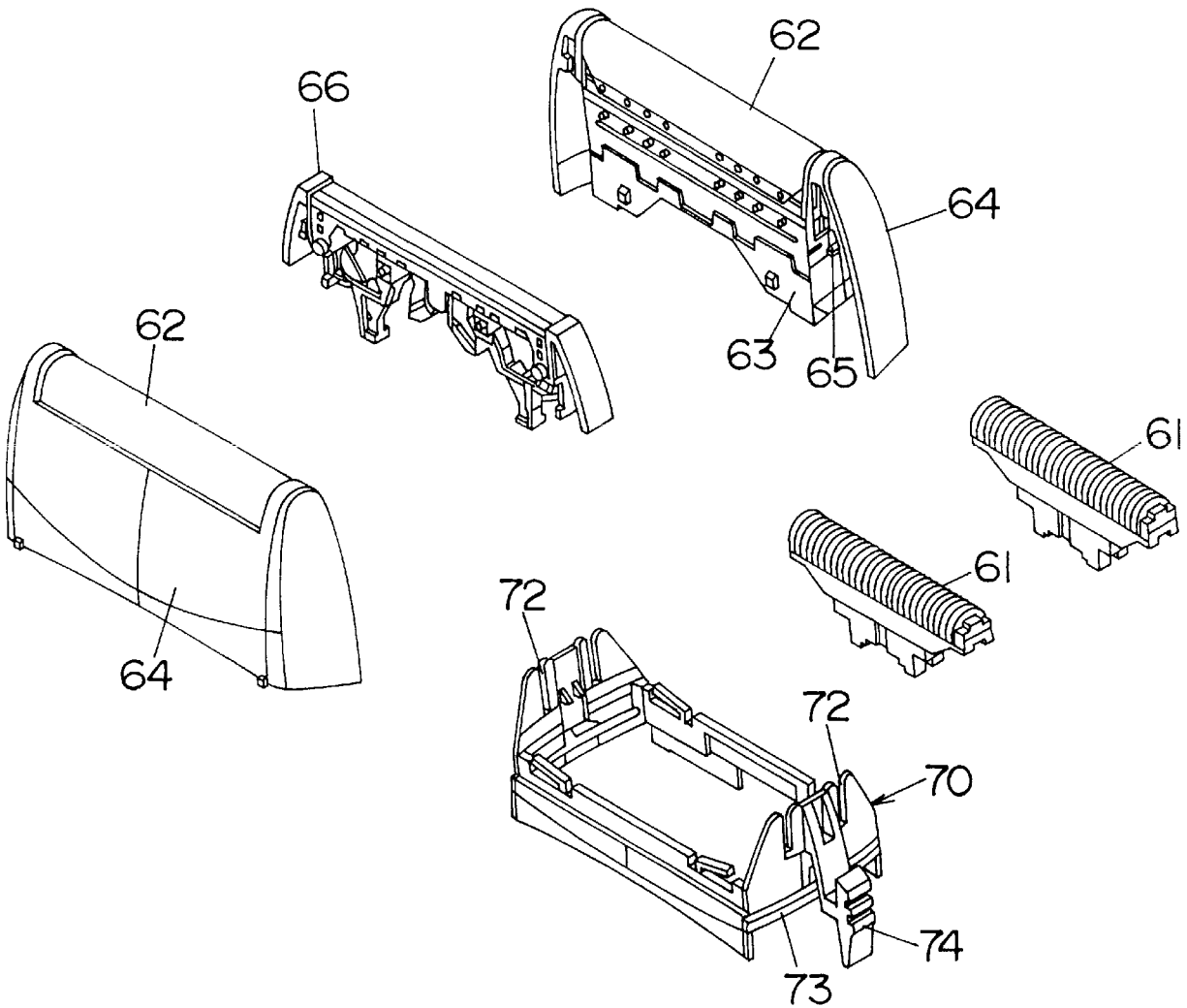
FIG. 5 is an exploded perspective view of a cutter head of the shaver.

As best shown in FIG. 5, the cutter head 60 comprises a pair of outer cutters 62 each in the form of a curved shearing foil fixedly supported to a cutter holder 63, and a head frame 70 movably supporting the cutter holders 63 to make the cuter holder vertically movable relative to the head frame 70. Each cutter holder 63 is provided with a fixed head cover 64 surrounding the outer cutter 62 in such a manner that the outer cutter 62 projects on the head cover 64. The head frame 70 is detachably supported to the mount frame 30 at the top of the housing 10 to place the outer cutters 62 in shearing contact with the inner cutters 61 respectively.

Each drive element 42 carries a bias spring 44 which urges the inner cutter 61 upwardly against the outer cutter 62 to develop a contact pressure therebetween. The bias spring 44 is a coil spring having its lower end retained with the drive element 42 and having its upper end in pressed contact with the inner cutter 61, in a know manner as disclosed in detail in U.S. Pat. No. 5,715,601. The head cover 64 fixed to the cutter holder 63 is formed at its opposite longitudinal ends respectively with lugs 65 which fit slidably into corresponding vertical grooves 72 in opposite end walls of the head frame 70 so that the cutter holder 63 is vertically movable relative to the head frame 70. Thus, when the head frame 70 is mounted to the top of the housing 10, each cutter holder 63 can be depressed against the bias spring 44, i.e., be floatingly supported to the head frame 70 by use of the bias spring 44. The cutter holders 63 each carrying the outer cutter 62 are provided for short hair shaving, while a long hair shaving cutter unit 66 is also supported to the head frame 70 between the cutter holders 63 in such a manner as to be capable of being depressed against another bias spring (not shown) held at the interface between the long hair cutter unit 66 and the head frame 70.

Figure 2:
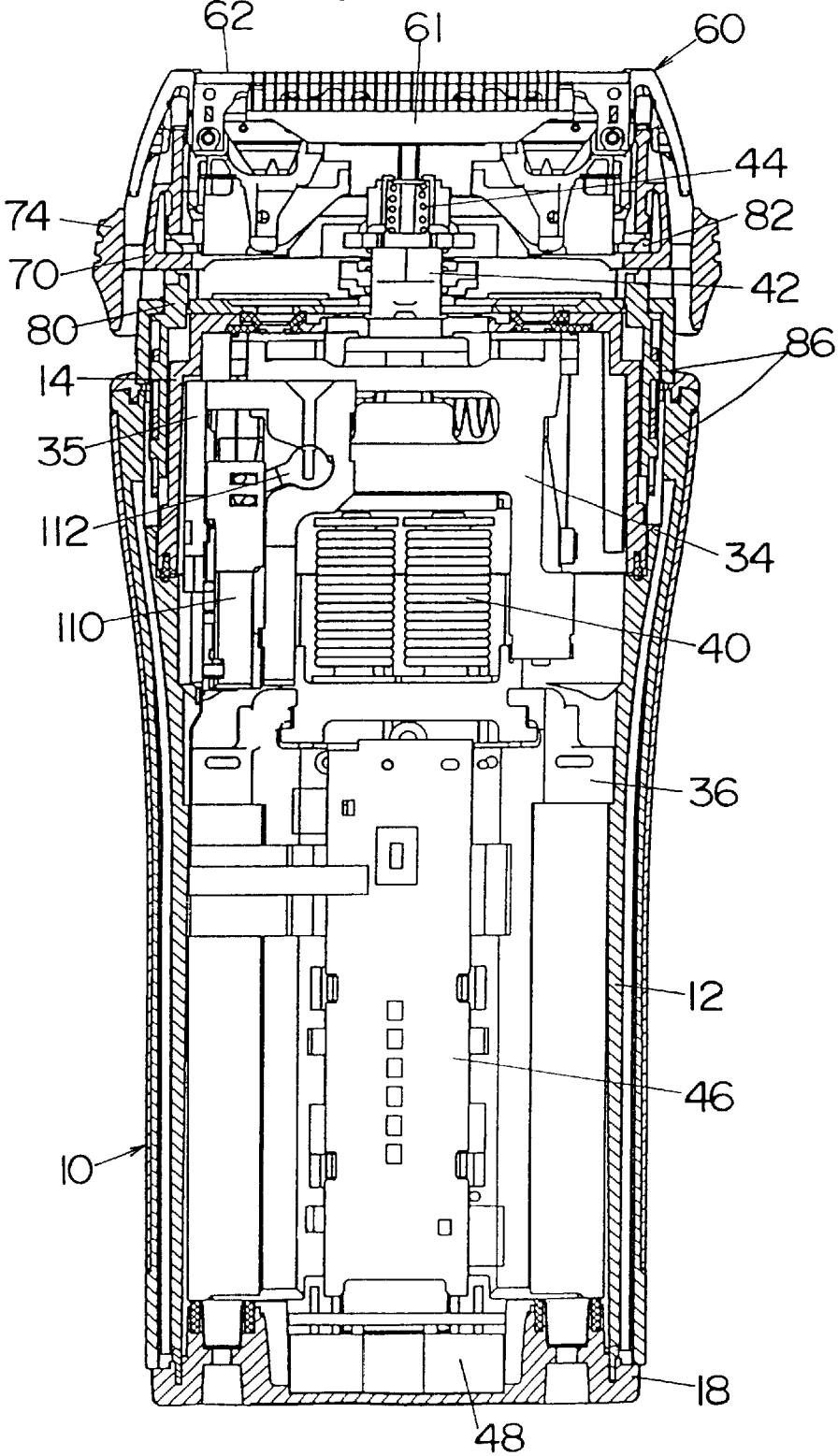
FIG. 2 is a front sectional view of the shaver.
Figure 3:
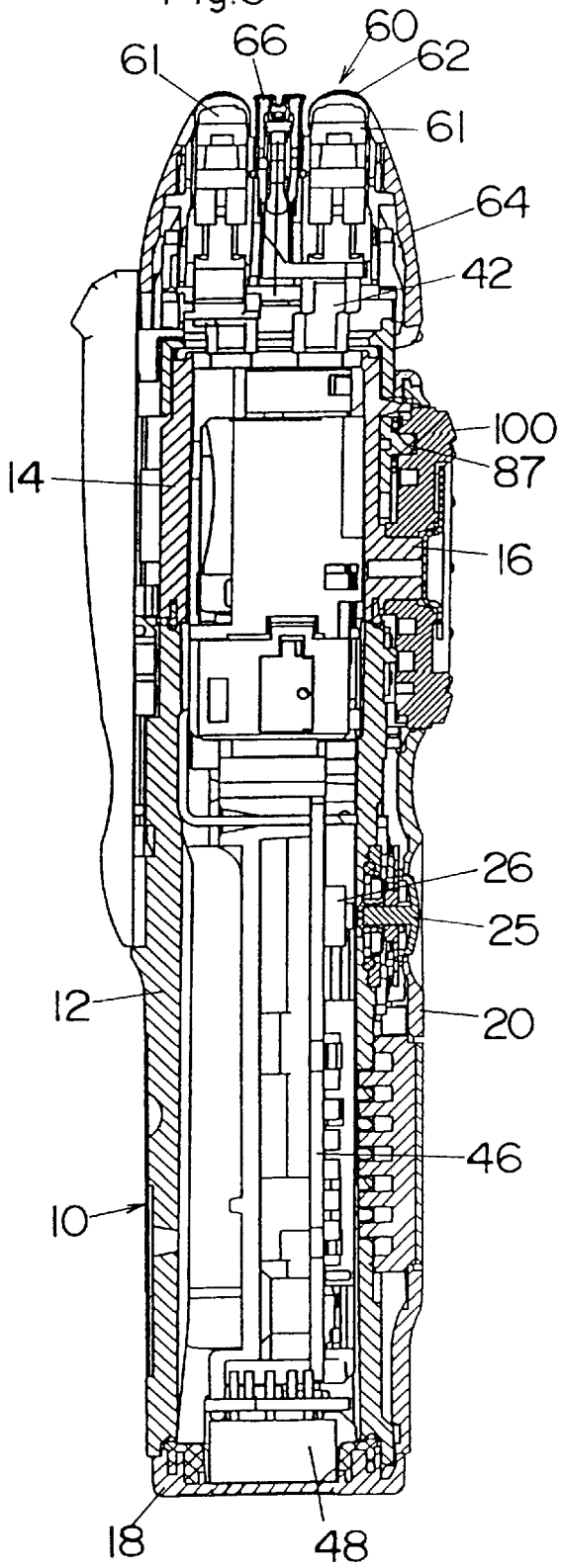
FIG. 3 is a side sectional view of the shaver.
Figure 6:
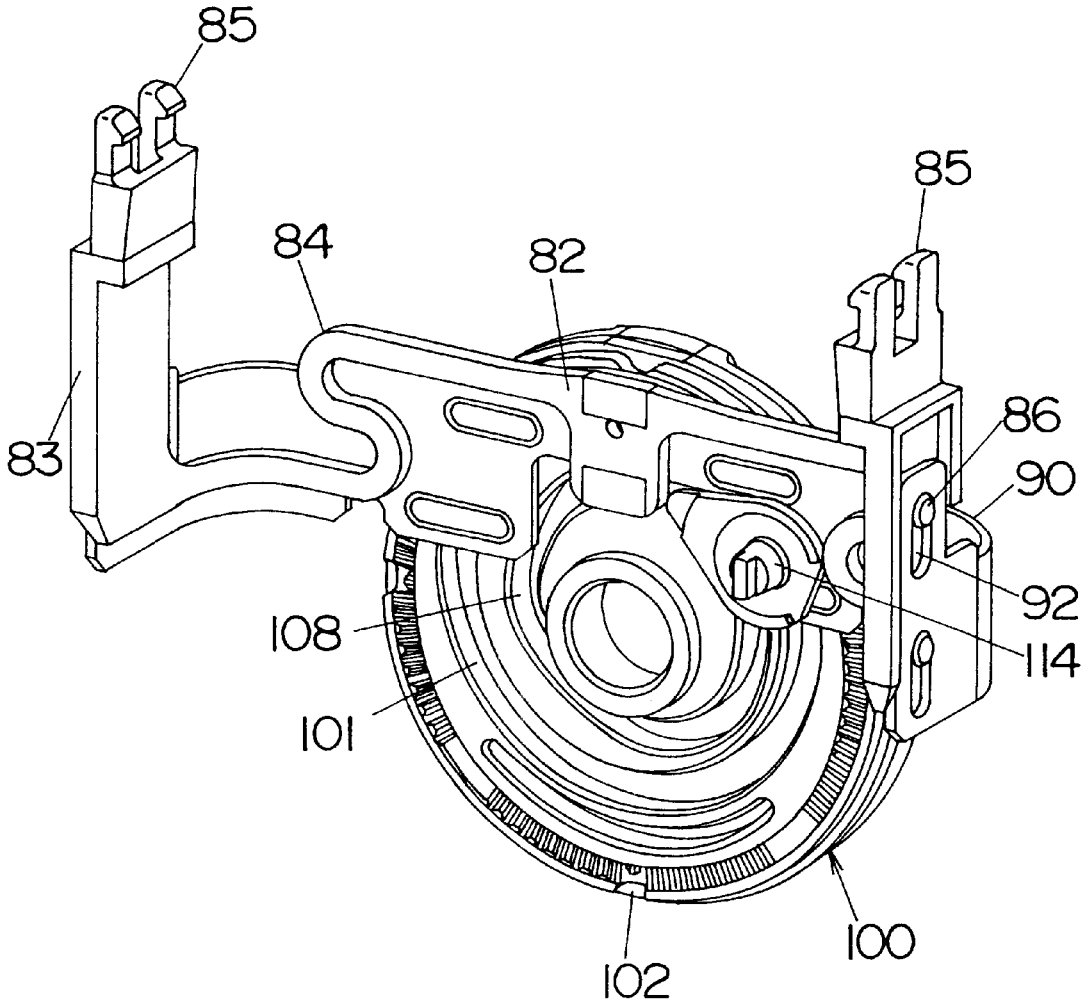
FIG. 6 is a perspective view of a height adjusting mechanism utilized in the shaver.
Figure 7:
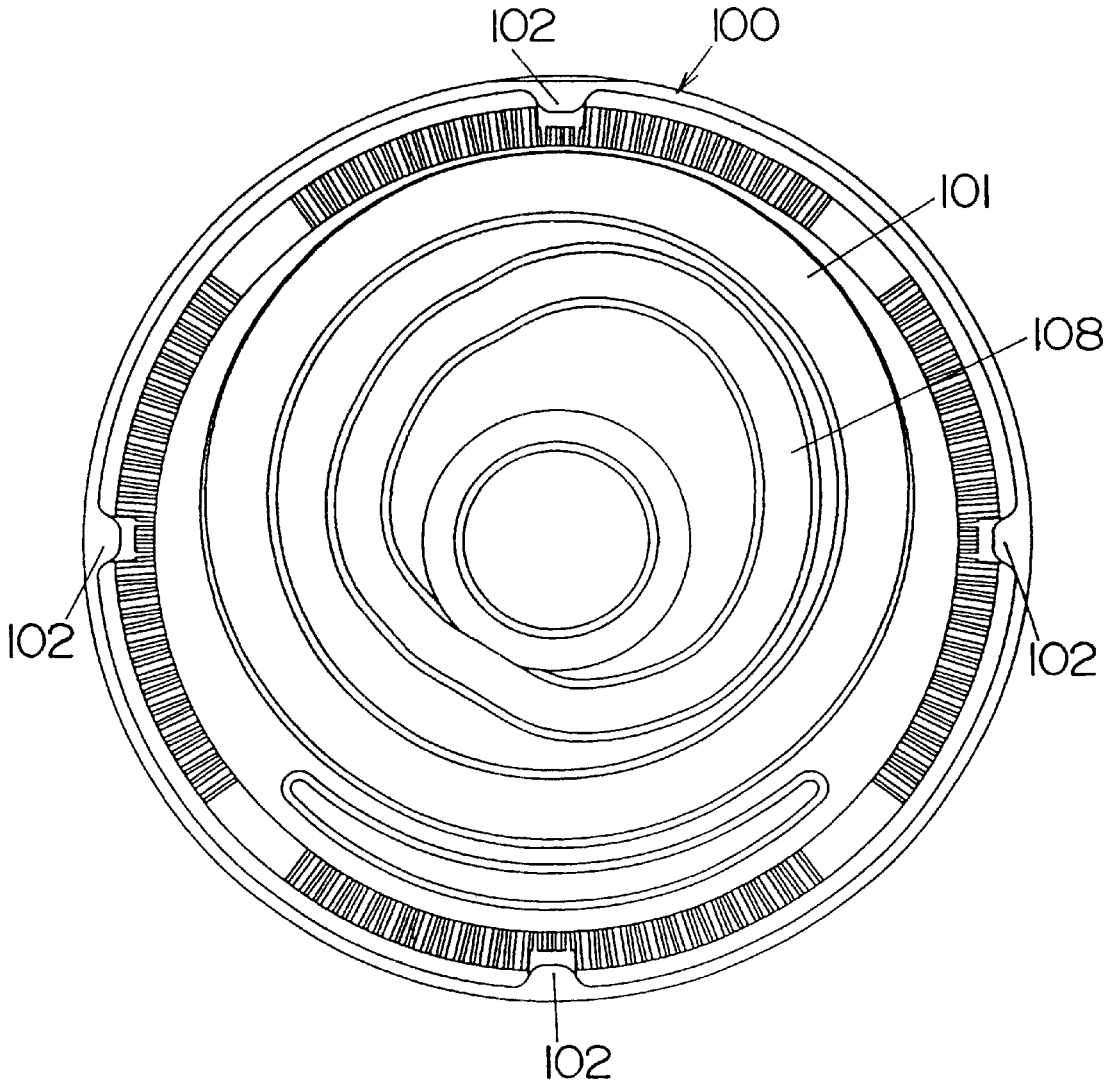
FIG. 7 is a rear view of a dial utilized in the height adjusting mechanism.

The head frame 70 thus supporting the outer cutters 62 is mounted on top of the housing 10 and is connected to a height adjust mechanism so as to be vertically movable relative to the housing 10 between a high position of FIG. 1 and a low position. As shown in FIG. 4A, the height adjust mechanism comprises a slider 80, a rigid guide 90, and a handle or dial 100 all supported on the upper shell 14 at the upper end of the housing 10. The slider 80 is made of a plastic material to have a base member 82 and a pair of vertical plunger 83 extending from opposite ends of the base member 82 integrally through resilient legs 84, respectively, as shown in FIGS. 4A and 6. The plunger 83 are loosely received respectively in grooves 15 formed in opposed side walls of the upper shell 14, while the base member 82 is held slidable on the front wall of the upper shell 14, so that the slider 80 is vertically slidable relative to the upper shell 14, i.e., the housing 10. Each plunger 83 is formed at its upper end with a hook 85 which projects through an opening 31 at each longitudinal end of the mount frame 30 for detachable connection to the head frame 70, as shown in FIG. 2. For this purpose, the head frame 70 is formed at opposite end walls with ridges 73, as shown in FIG. 5, for detachable engagement with the hooks 85. Projecting on the center of the base member 82 is a cam follower pin 87 which fits into a cam groove 101 in the rear of the dial 100. The dial 100 is mounted to a bearing boss 16 to be rotatable about a rotary axis. As shown in FIGS. 6 and 7, the cam groove 101 extends in an eccentric fashion about the rotary axis so that the rotary motion of the dial 100 is translated into a vertical movement of the slider 80 for adjusting the height of the cutter head 60 relative to the housing 10 between the high position of FIG. 8A and the low position of FIG. 8B, while varying the contact pressure developed between the inner cutter 61 and the outer cutter 62.

The cam groove 101 is configured to have a varying curvature along its path to have a minimum curvature at a portion where the follower pin 87 engages when the head frame 70 is around the low position. Therefore, the cam follower pin 87 travels less distance with respect to a radial direction of the dial 100 per unit angular movement thereof, thereby enabling to manipulate the dial 100 with less force even against the increased force due to the depressed bias spring when the cutter head 60 is around the low position. Although the illustrated embodiment disclose the cam groove 101 of annular configuration, it may be configured into an arcuate groove.

Figure 10:
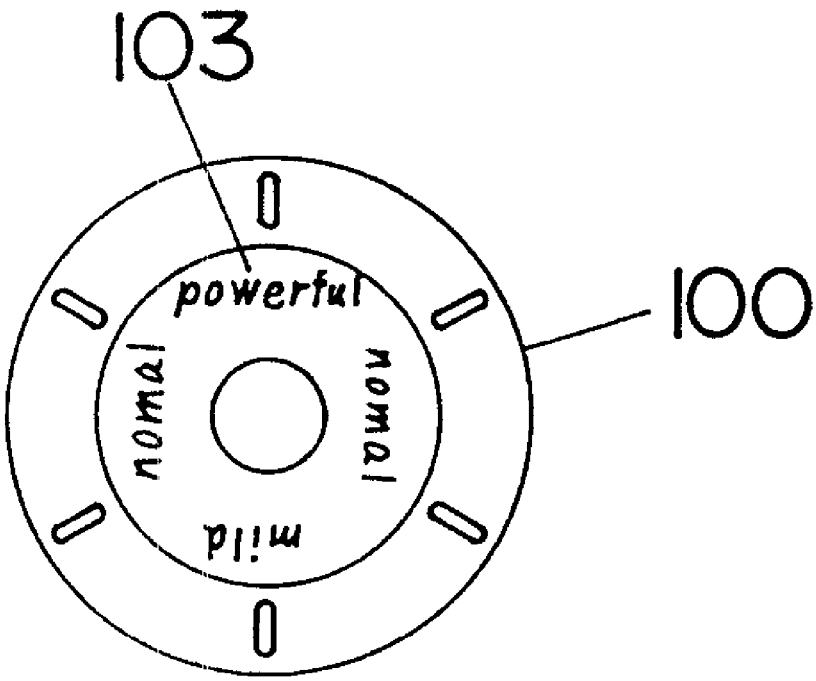
FIG. 10 is a front view of the dial.

The dial 100 is latched by means of a latch spring 105 seated on the tube 12 in order to hold the cutter head 60 selectively at the high position, the low position, and further an intermediate position. The latch spring 105 has its pawl 106 engaging selectively into one of four notches 102 formed in the rear of the dial 100 and spaced circumferentially therealong, as shown in FIG. 7. In addition, the housing may be provided with a click spring which engages with serrations on the back of the dial to give a click resistance to a rotary movement of the dial. When the cutter head 60 is in the high position, the bias spring 44 is compressed to a small extent to give the minimum but enough contact pressure for shearing soft hairs. When the cutter head 60 is lowered to the intermediate position, the bias spring 44 is compressed to some extent to give an intermediate contact pressure. When the cutter head 60 is lowered down to the low position, the bias spring 44 is compressed further to give a strong contact pressure effective for shearing hard hairs. At any position, the cutter head 60, i.e., the outer cutter 62 can be still depressed further against the bias spring 44 due to the relative vertical movement of the cutter holder 63 to the head frame 70, enabling to keep the outer cutter in constant contact with the skin while moving the cutter head across the skin for successfully shaving the hairs. Since the high position is effective for sharing the soft hairs, and the low position is effective for the hard hairs, the high, low, and intermediate positions can be referred also to a mild shaving position, a powerful shaving position, and a normal shaving position. In order that the user can be easily confirmed of the position of the cutter head 60, the dial 100 is provided with markings 103 "mild", "powerful", and "normal", as shown in FIG. 10. One of the markings appears on front of the dial 100, while the others are concealed behind a plate 104 fixed to the boss 16.

Turning back to FIG. 4A, the rigid guide 90 is placed over the slider 80 and is connected thereto by engaging the cam follower pin 87 into a hole 91 at the center of the guide 90 so as to be movable together with the slider 80. The guide 90 is shaped from a rigid metal to have at its opposite ends vertically elongated slots 92 which receive corresponding studs 86 on the plunger 83 of the slider 80, as shown in FIG. 6. Each stud 86 is normally located at the upper end of the slot 92 and is allowed to move vertically downwardly to the lower end of the slot 92 by deforming the resilient leg 84 when an excessive impact is applied to the cutter head 60. With this arrangement, the height adjusting mechanism can be protected from the excessive impact accidentally applied to the cutter head 60, for example, when the shaver is dropped to the floor. In this regard, the guide 90 is cooperative with the slider 80 to define a restrictor which restricts the resilient movement of the cutter head to a suitable extent.

The dial 100 has its major portion received within a compartment formed between the front cover 20 and the main case of the housing 10, and has its front face exposed through a hole 22 in the front cover 20 to be accessible by a thumb of the user's hand grasping the housing 10. For an easy manipulating purpose, the dial 100 has a plurality of radial ribs 107 assisting a firm contact with the thumb. Also disposed in the compartment is a power switch button 25 which is accessible through a hole 24 in the front cover 20. The switch button 25 has a rearward projecting actuator which projects through the tube 12 for contact with a power switch 26 inside of the housing 10 for energizing and deenergizing the motor 40 when the button is pressed. The interconnection between the button 25 and the switch 26 is sealed by a bushing 17 to keep the main case water-tight. As described hereinbefore, all the moving parts forming the height adjust mechanism are disposed in the compartment and exteriorly of the water-tight housing 10 and can be therefore readily added to the shaver without sacrificing the water-tight structure of the housing.

The dial 100 is disposed upwardly of the power switch button 25 so that the user is easy to manipulate the dial 100 by a thumb of the user's hand continuously after pushing the switch button 25 by the thumb, whereby the height adjustment of the cutter head 60 can be made without interruption or regripping the housing 10 Further, the dial 100 is located on the front face of the housing 10 centrally with respect to a width dimension thereof so that both of the right-handed and left-handed user can be easy to make the height adjustment.

Again turning back to FIG. 5, the head frame 70 has on its opposite ends release buttons 74 which project on the cutter head 60 and are respectively received in slots 32 formed in end walls of the mount frame 30, when the head frame 70 is connected to the hooks 85 of the slider 80. Upon being pressed, the release buttons 74 act to disengage the ridges 73 of the head frame 70 from the hooks 85, permitting the removal of the cutter head 60 from the mount frame 30. At any position of the cutter head 60, the head frame 70 has its lower periphery overlapped with the periphery of the mount frame 30 to form a barrier wall surrounding the top surface of the mount frame 30 where the sheared hairs accumulate. Thus, the sheared hairs can be protected from scattering outwardly. In this connection, the end walls and the side walls of the head frame 70 are held in close slidable contact respectively with end walls and side walls of the mount frame 30 for guiding the vertical movement of the head frame 70 correctly and reliably. The head cover 64 is spaced from the walls of the mount frame 70 by a sufficient gap for allowing the cutter holder 63 to move relative to the head frame 70.

Figure 8A:
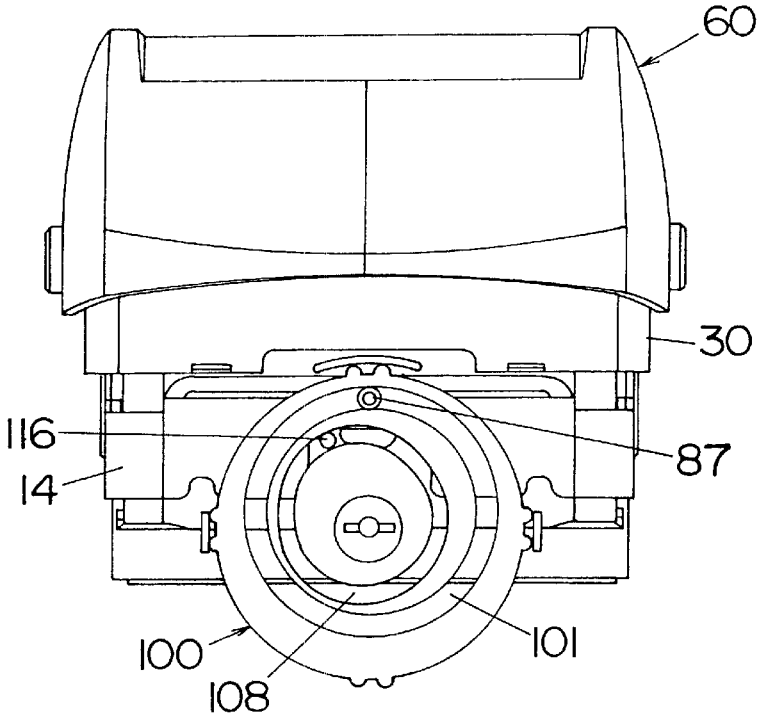
FIGS. 8A and 8B show the cutter head held in an uppermost position and a lowermost position, respectively.
Figure 8B:
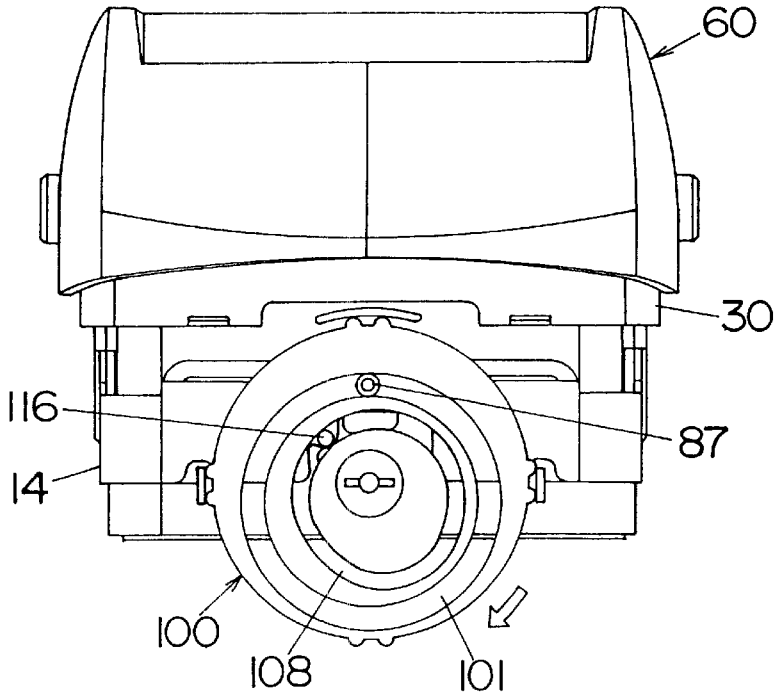
Figures 9A, 9B, 9C:
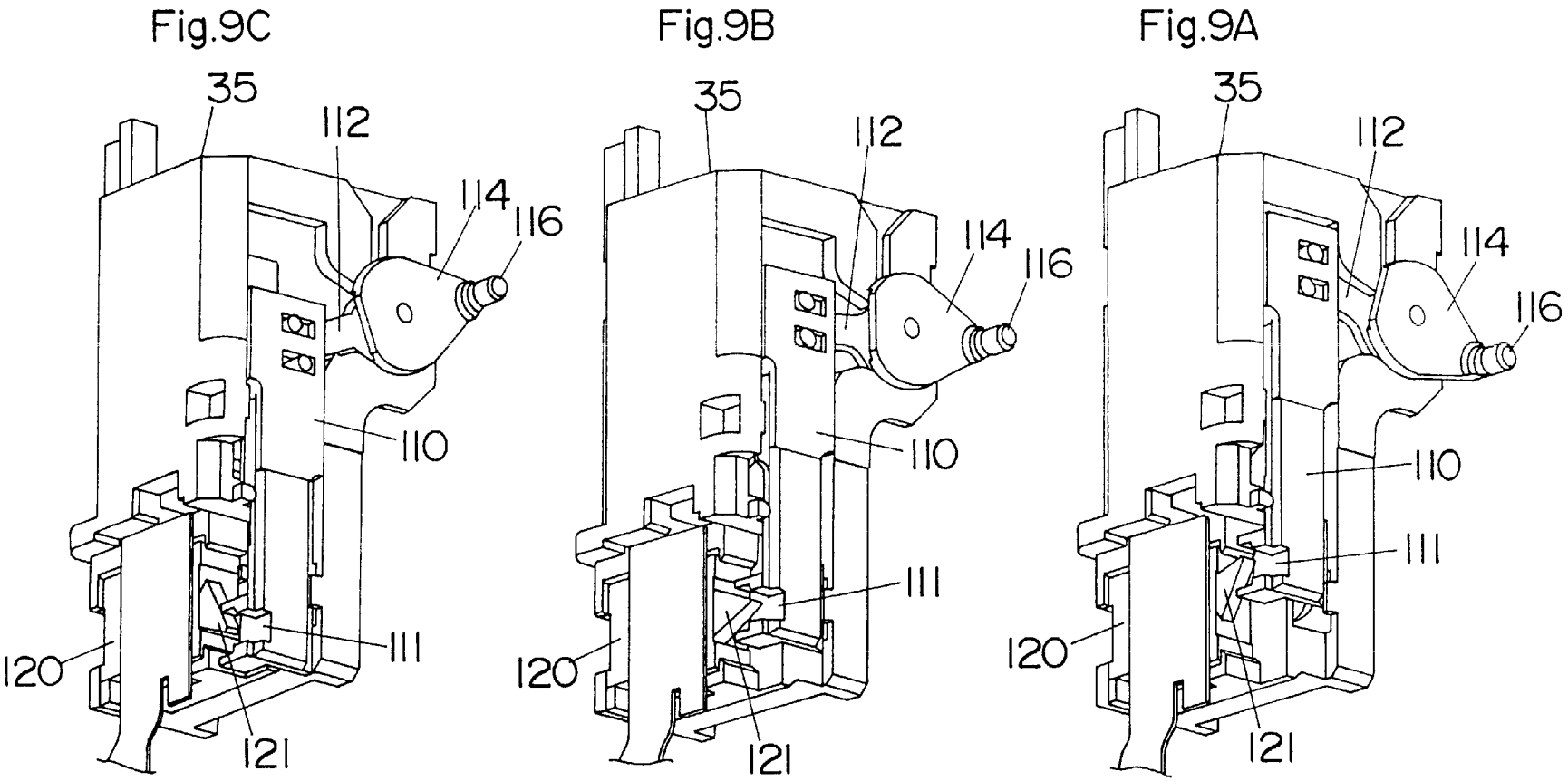
FIGS. 9A, 9B, and 9C show a mechanism of interlocking the cutter head with a switch for controlling the speed of an inner cutter of the shaver.

The shaver includes a speed controller for varying the speed of the inner cutter 61 in accordance with the position of the head frame 70 or the cutter head 60 relative to the housing 10. The speed controller is composed of a position sensor for sensing the position of the cutter head 60, and a current regulator which varies an electric current being supplied to the motor 40 in accordance with the output of the sensor. The sensor comprises a bar 110 interlocked with the dial 100 to be movable together with the slider 80, i.e., the cutter head 60 connected thereto, and a three-position selector switch 120 having an actuator 121 engaged with a notch 111 at the lower end of the bar 110, as shown in FIGS. 9A to 9C. The bar 110 is slidably supported to a frame 36 secured to the upper chassis 34 and has its upper end connected to the dial 100 through a linkage of a pivot arm 112 and a cam lever 114. The pivot arm 112 is pivotally supported to the frame 35 to have one end connected to the upper end of the bar 110. The cam lever 114 is pivotally supported on the exterior of the upper shell 14 and is connected through the wall of the upper shell 14 to the pivot arm 112 at a portion opposite of the connection with the bar 110. The cam lever 114 has a follower pin 116 which fits into another cam groove 108 in the rear of the dial 100, as shown in FIGS. 8A and 8B, so that the rotary motion of the dial 100 is translated into the vertical movement of the bar 110 in an exact correspondence with the vertical movement to the slider 80. That is, when the cutter head 60 is moved into the high position by rotating the dial 100, the bar 110 is moved to its upper most position, as show in FIG. 9A, at which the actuator 121 of the switch 120 is moved into a first position of providing a first output. When the cutter head 60 is lowered to the intermediate position, the bar 110 is correspondingly lowered to an intermediate position, as shown in FIG. 9B, where the actuator 121 is changed to a second position of providing a second output. In response to the cutter head 60 being further moved to the low position, the bar 110 is lowered to a lowest position, as shown in FIG. 9C, where the actuator 121 is switched to a third position of providing a third output. The switch 120 is connected in circuit with the current regulator realized on the circuit board 46 to vary the motor current in accordance with the first, second, and third output of the switch 120 in such a manner as to increase the motor current and therefore the speed of the inner cutter 61 stepwise as the cutter head is lowered from the high position to the low position. Thus, the inner cutter 61 can be given a stronger shearing force in compensation for the increased contact pressure developed between the inner cutter and the outer cutter as the cutter head 60 is lowered to the low position, assuring successful shearing of the hard hairs in much the same way as shearing the soft hairs with the cutter head 60 in the high position where less shearing force is sufficient in balance with the light contact pressure between the inner and outer cutters. The connection of the cam lever 114 with the pivot arm 112 is sealed by a bushing 117 to keep the interior of the upper shell 14 water-tight.

Instead of utilizing the switch 120, the current regulator may include a variable resistor connected to limit the motor current. The variable resistor may be formed to extend along a length of the bar and a fixed contact tap in sliding contact with the variable resistor so as to vary an effective length of the resistor, i.e., to vary the resistance to be connected in circuit to flow the motor current. Alternatively, the variable resistor is formed directly around the dial 100 or around a member rotating together with the dial to vary the resistance with the use of a corresponding fixed contact tap as the dial rotates to adjust the height of the cutter head 60. Further, it is still possible to use a variable resistor of rotary type which is connected to rotate together with the dial 100 for varying the resistance according to the varying position of the cutter head 60.

For the inner cutter 61 driven to reciprocate, the speed controller may be otherwise configured to vary a reciprocation amplitude of the inner cutter for varying the speed of the inner cutter in accordance with the varying position of the cutter head. In a modified version where a height adjustable cutter head employs an inner cutter which is driven to rotate in contact with an outer cutter, the shaver may include a like speed controller which varies the rotation speed of the inner cutter in accordance with the varying position of the cutter head. Although the above speed controller of varying the speed of the inner cutter is advantageous for successfully shaving the hairs at any position of the cutter head 60, the speed controller may be otherwise configured to keep the speed of the inner cutter constant irrespective of the position of the cutter head 60. For this purpose, the speed controller can be designed to include a motor sensor for sensing the motor speed for feedback control of keeping the motor speed constant.

Figure 11:
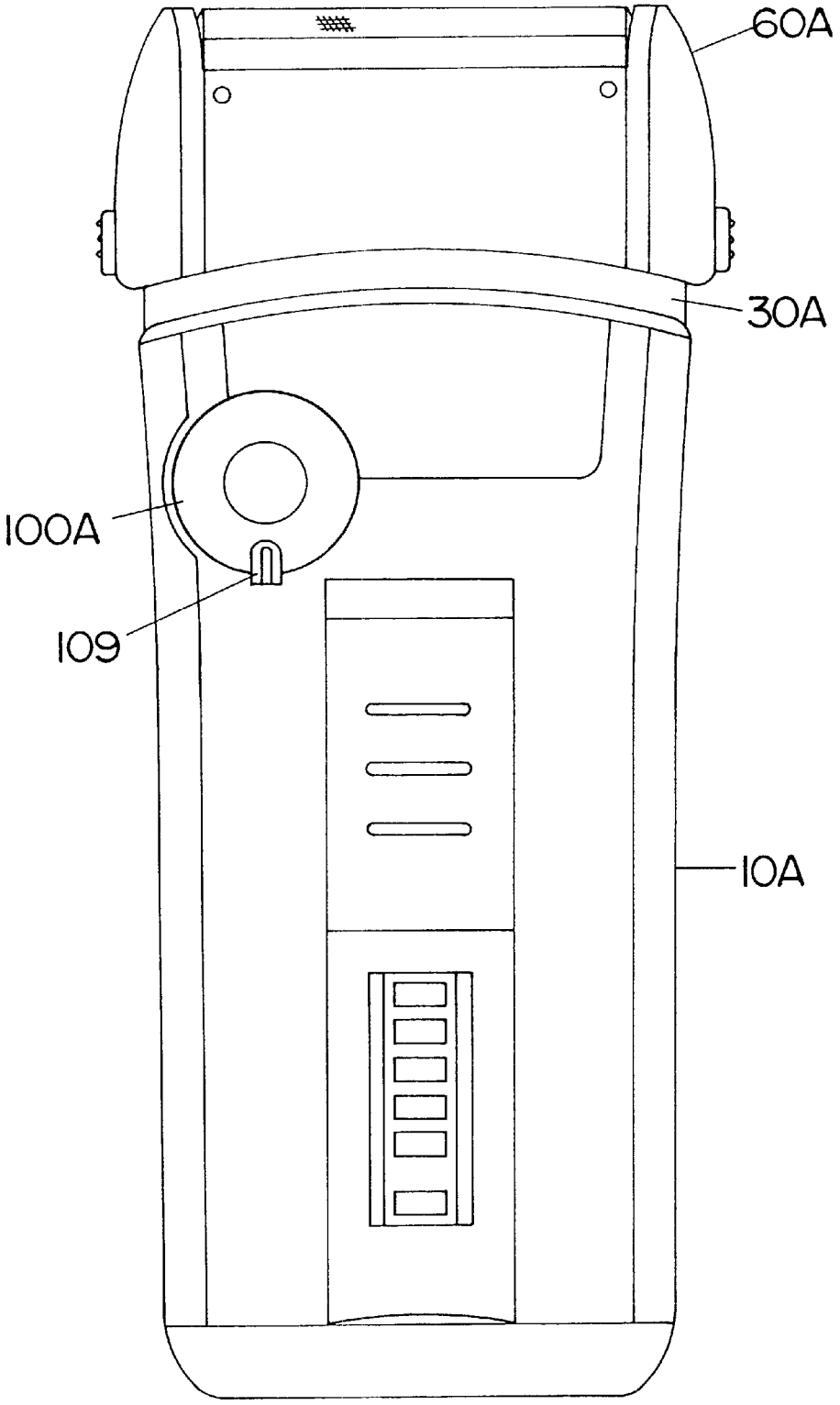
FIG. 11 is a front view of a dry shaver in accordance with a second embodiment of the present invention.
Figure 12:
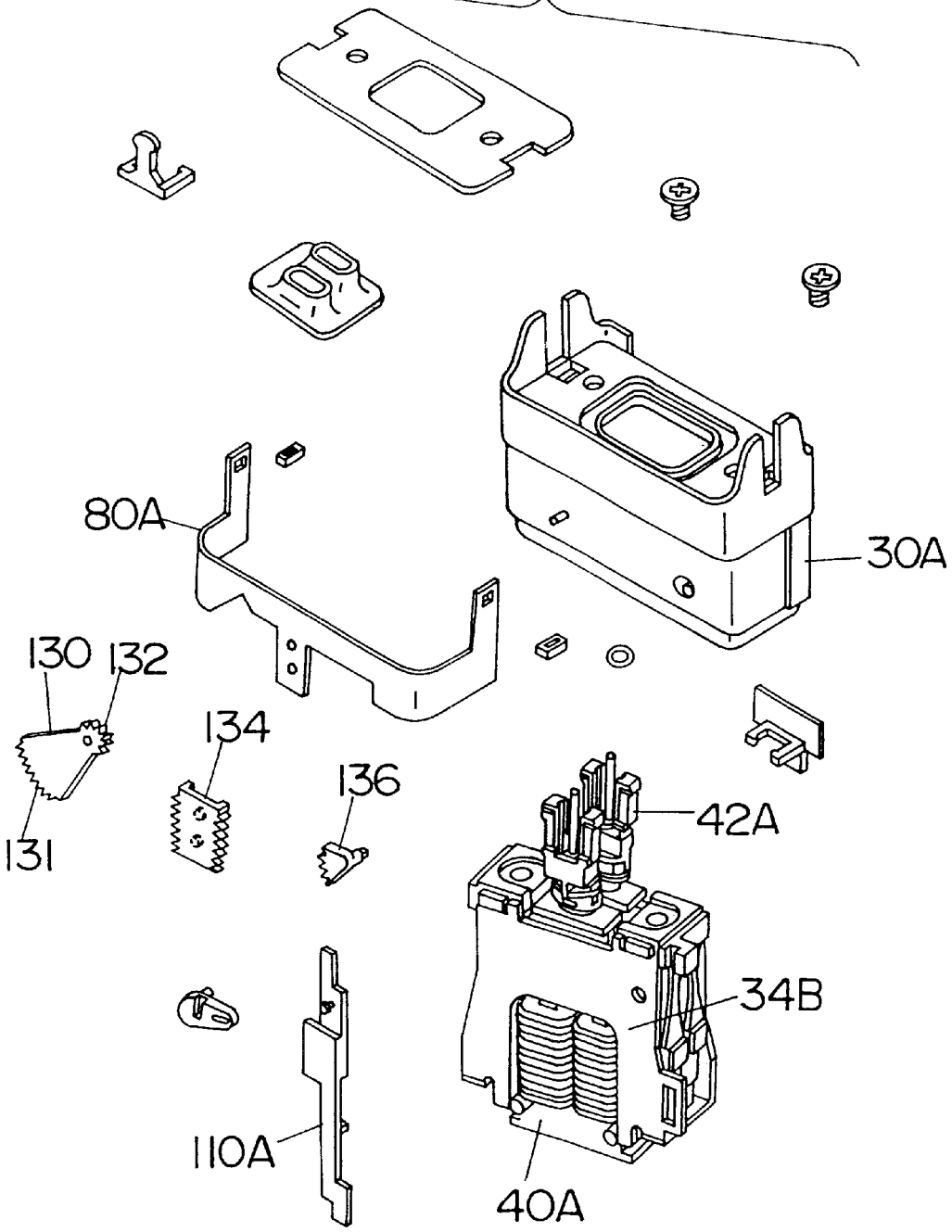
FIG. 12 is an exploded perspective view of a portion of the shaver.

Second Embodiment <FIGS. 11 to 13>

FIGS. 11 and 12 show a dry shaver in accordance with a second embodiment of the present invention which is identical to the first embodiment except for details of the height adjust mechanism. Like parts are designated by like reference numerals with a suffix letter of "A". The height adjust mechanism comprises a like slider 80A but of rigid nature, and a like dial 100A connected to the slider 80A by way of a reduction gear train composed of a composite gear 130 and a rack 134 secured to the center of the slider 80A, as shown in FIG. 12. The composite gear 130 is composed of a first gear section 131 and a second gear section 132 which has a pitch diameter smaller than the first gear section. The first gear section 131 is kept in meshing engagement with a pinion 135 on the back of the dial 100A, while the second gear section 132 is in meshing engagement with the rack 134 so as to covert the rotary motion of the dial 100A into the vertical movement of the slider 80A for adjusting the height of the cutter head 60A relative to the housing 10A.

Figure 13B:
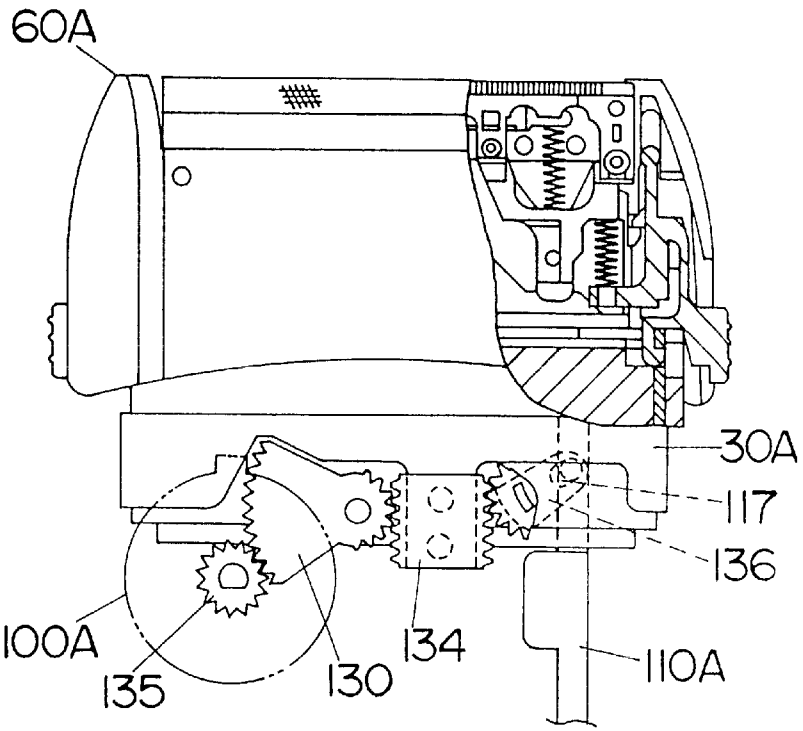
FIGS. 13A and 13B show a cutter head of the shaver held in a high position and a low position, respectively.
Figure 13A:
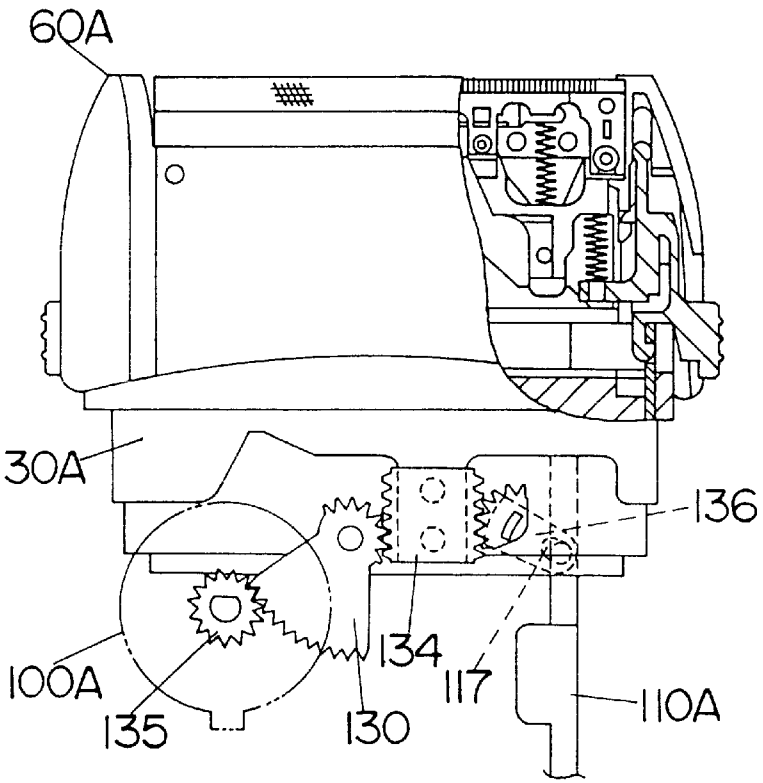

A like bar 110A is utilized to interlock the cutter head 60A to a like position sensor for varying the speed of the inner cutter according to the varying position of the cutter head 60A. The bar 110A is connected at its upper end to the slider 80A through a gear 136 which meshes at its one end with the rack 134 and engages at the other end with a slot 117 in the upper end of the bar 110A. Thus, the vertical movement of the slider 80A is transferred to the vertical movement of the bar 110A, as shown in FIGS. 13A and 13B, for controlling the speed of the inner cutter in the like manner as described with reference to the first embodiment.

The dial 110A is provided with a latch button 109 which holds the dial in a plurality of suitable angular positions for retaining the cutter head 60A at the corresponding positions of varying height from the housing 10A, for example, the high, low, and intermediate positions as is made in the first embodiment. Further, a click spring may be provided to give a click resistance to the rotary motion of the dial.

Figure 14:
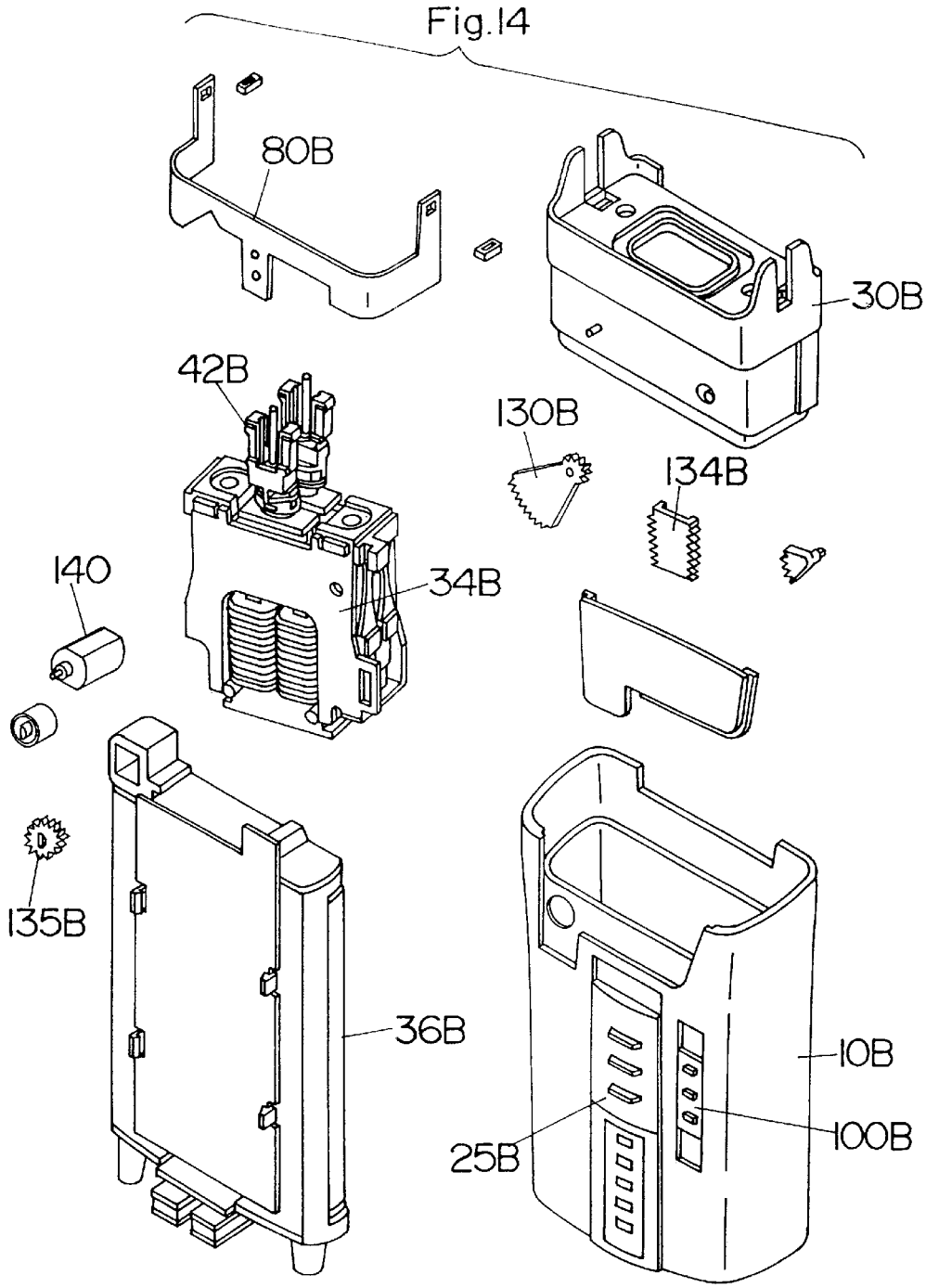
FIG. 14 is an exploded perspective view showing a modification of the above shaver.

FIG. 14 illustrates a modification of the second embodiment which is identical to the second embodiment except for the use of a rotary motor 140 instead of the dial. Like parts are designated by like reference numerals with a suffix letter of "B". The motor 140 is supported to a like lower chassis 36B and is connected to drive a pinion 135B which engages with the rack 134B through the composite gear 130B for moving the slider 80B vertically. The motor 140 is controlled by an adjustor handle 100B slidably mounted on the housing 10B adjacent to a power switch handle 25B. Thus, the motor 140 is controlled to adjust the position of the cutter head relative to the housing 10B by manipulating the adjustor handle 100B.

Third Embodiment <FIGS. 15 to 21>

Figure 17:
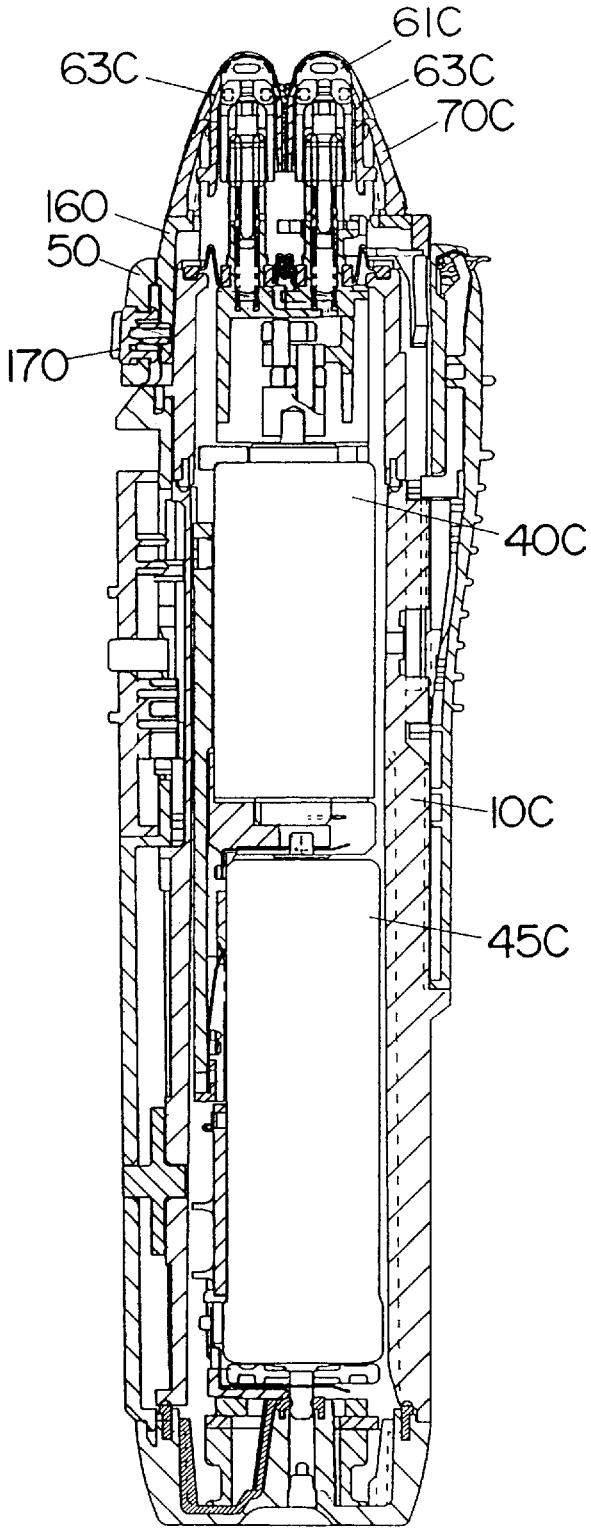
FIG. 17 is a side sectional view of the shaver.
Figure 18:
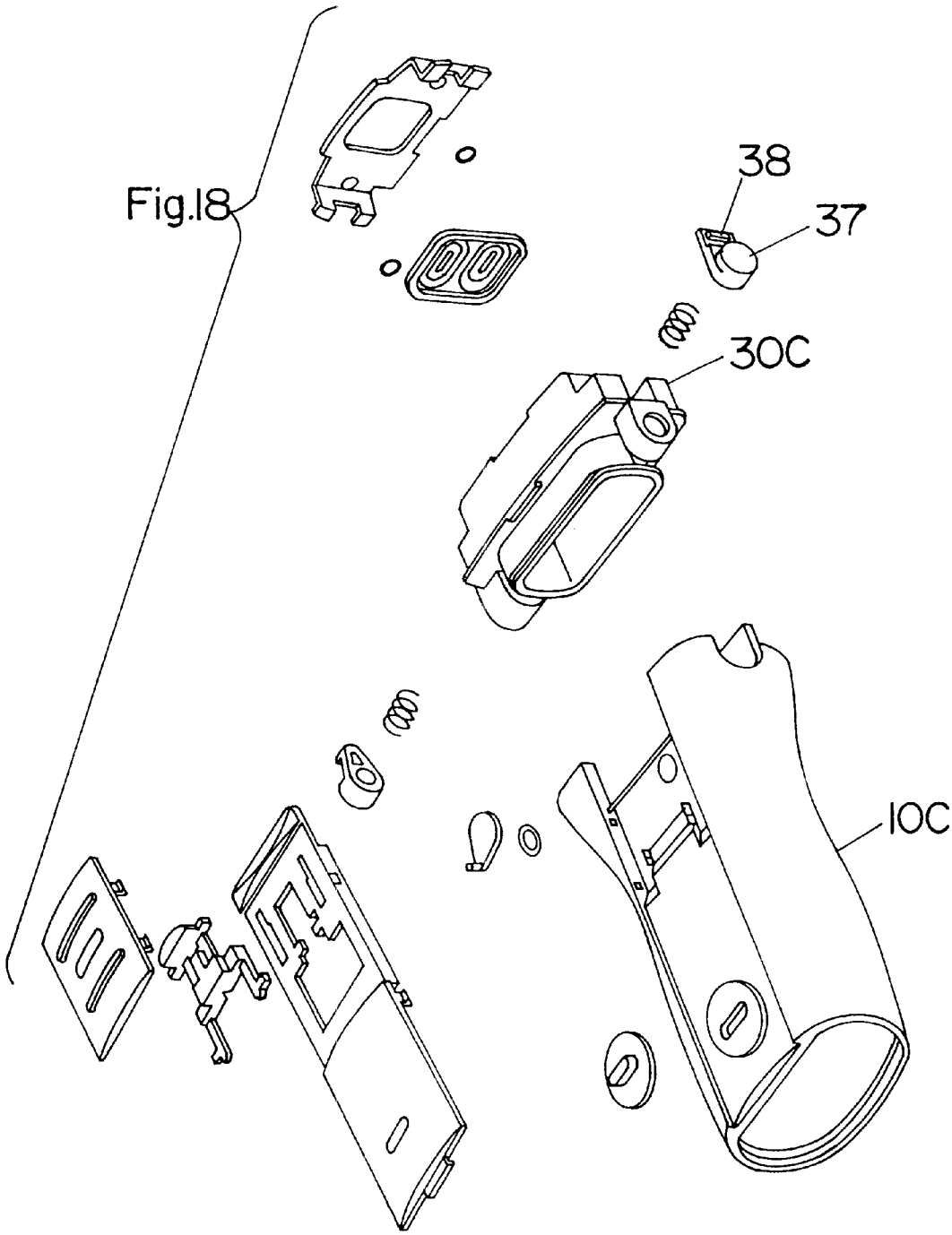
FIG. 18 is an exploded perspective view of a portion of the shaver.

FIGS. 15 to 22 show a dry shaver with a height adjustable cutter head in accordance with a third embodiment of the present invention which is basically identical to the first embodiment except for a design of the height adjust mechanism and an associated structure of a cutter head 60C. Like parts are designated by like reference numerals with a suffix letter of "C". The cutter head 60C carrying outer cutter 62C is mounted on top of a housing 10C which accommodates a motor 40C, a battery 45, and associated electrical parts in a water-tight sealed manner. The motor 40C is a rotary motor and is connected to a known motion-converter 41 which converts the rotary motion of the motor into a reciprocating motion of drive elements 42C projecting on top of the housing 10C. The drive element 42C is connected to an inner cutter 61C for reciprocation thereof and carries a bias spring 44C for developing a contact pressure between the inner cutter 61C and the outer cutter 62C. As shown in FIG. 18, the housing 10C is provided at its upper end with a mount frame 30C which mounts the detachable cutter head 60C and has release buttons 37 for detachment of the cutter head 60C.

Figure 15:
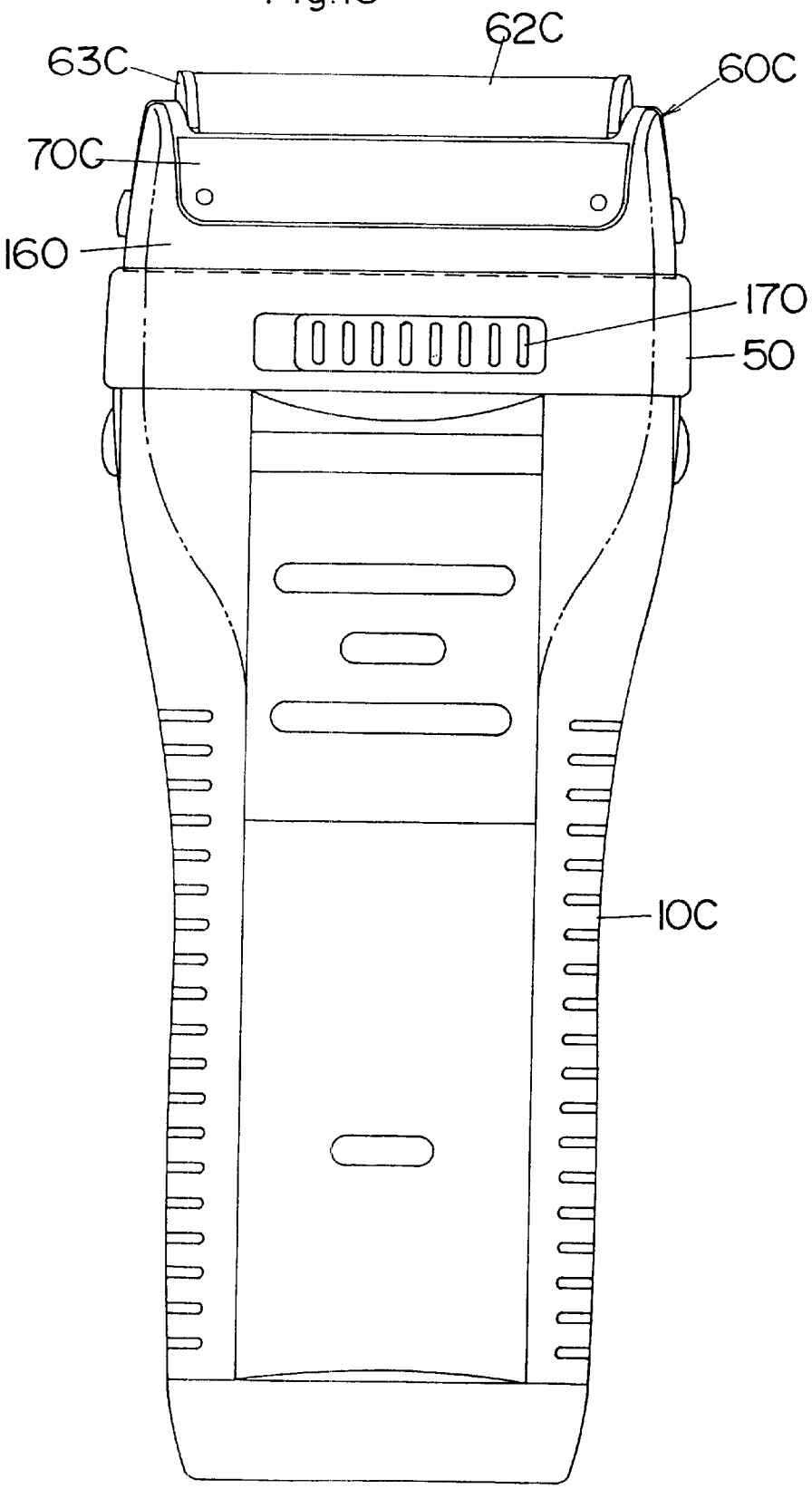
FIG. 15 is a front view of a dry shaver in accordance with a third embodiment of the present invention.
Figure 16:
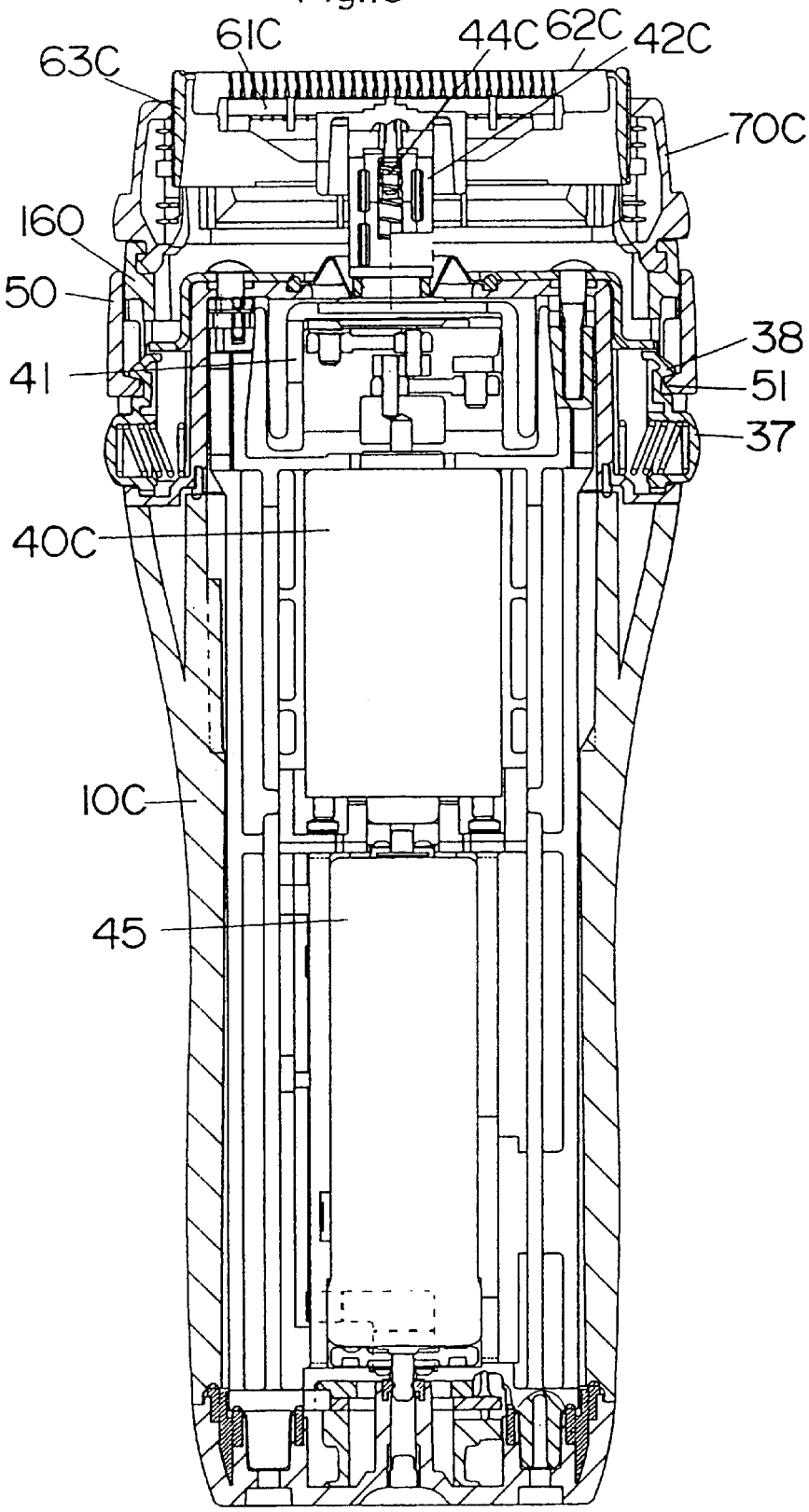
FIG. 16 is a front sectional view of the shaver.
Figure 19:
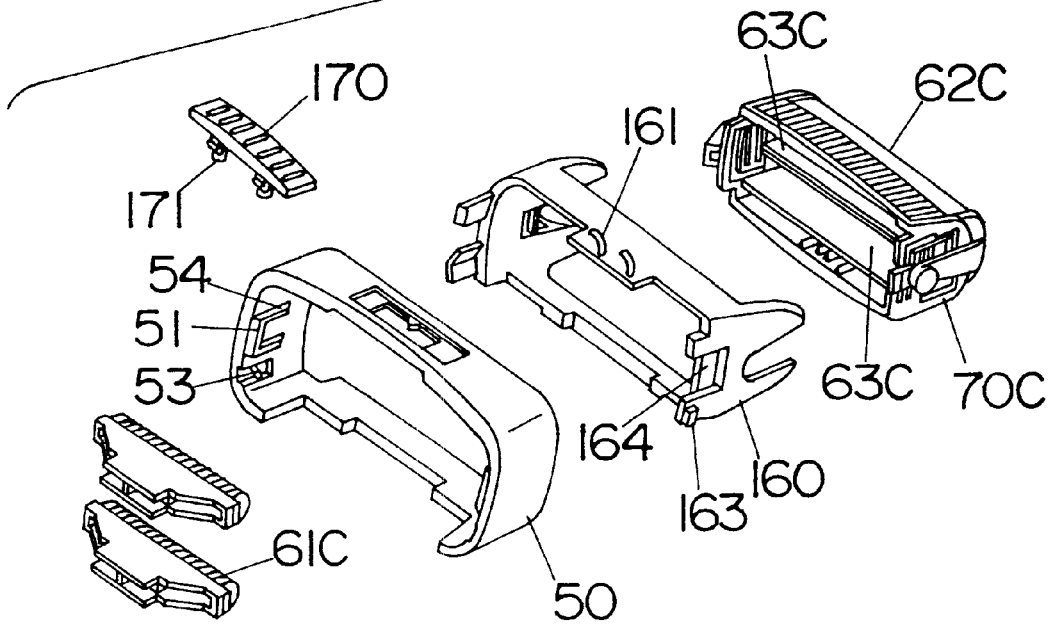
FIG. 19 is an exploded perspective view of a cutter head of the shaver.
Figure 20A:
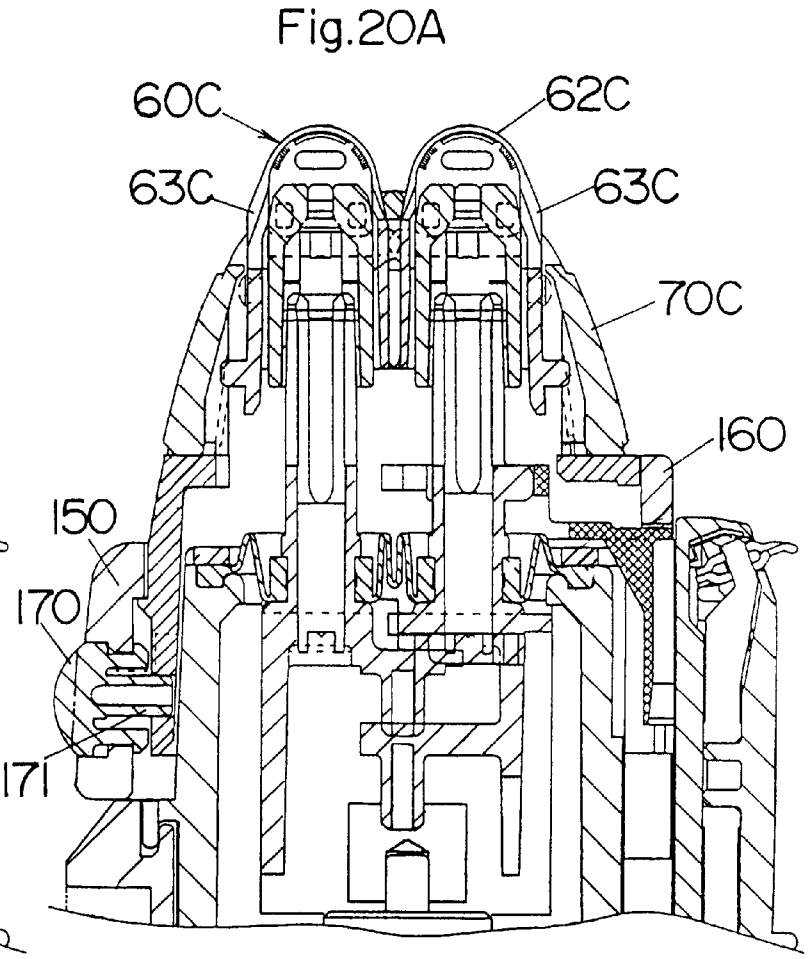
FIGS. 20A and 20B show the cutter head held in a high position and a low position, respectively.
Figure 20B:
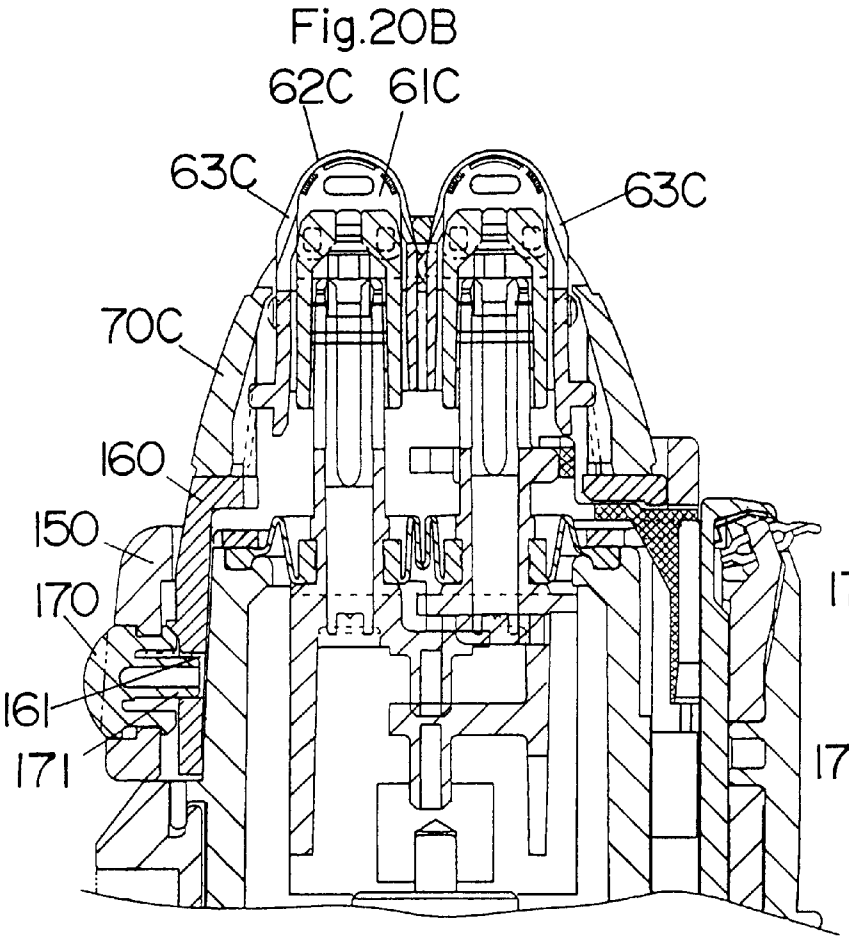

As shown in FIGS. 15, 17, and 19, the cutter head 60C is composed of two cutter holders 63C each carrying the outer cutter 62C, a head frame 70C supporting the cutter holders 63C, and a support frame 160 supporting the head frame 70C. The support frame 160 is mounted to a sleeve 50 so as to be vertically movable relative to the sleeve 50. The sleeve 50 is attached to the mount frame 30C of the housing 10C, so that the head frame 70C is made vertically movable together with the support frame 160 relative to the housing 10C for adjusting the height of the head frame 70C or the cutter head 60C between a high position and a low position. The sleeve 50 is made detachable to the mount frame 30C. For this purpose, the release button 37 has a hook 38 engaging a ridge 51 formed at lower interior end of each end wall of the sleeve 50. Each cutter holder 63C is supported to the head frame 70C to be vertically movable relative thereto so that it can be depressed against the bias spring 44C in the same fashion manner as described with reference to the first embodiment. The head frame 70C carrying the outer cutters 62C is made detachable to the support frame 160 for easy replacement of the outer cutters 62C.

Figure 21A:
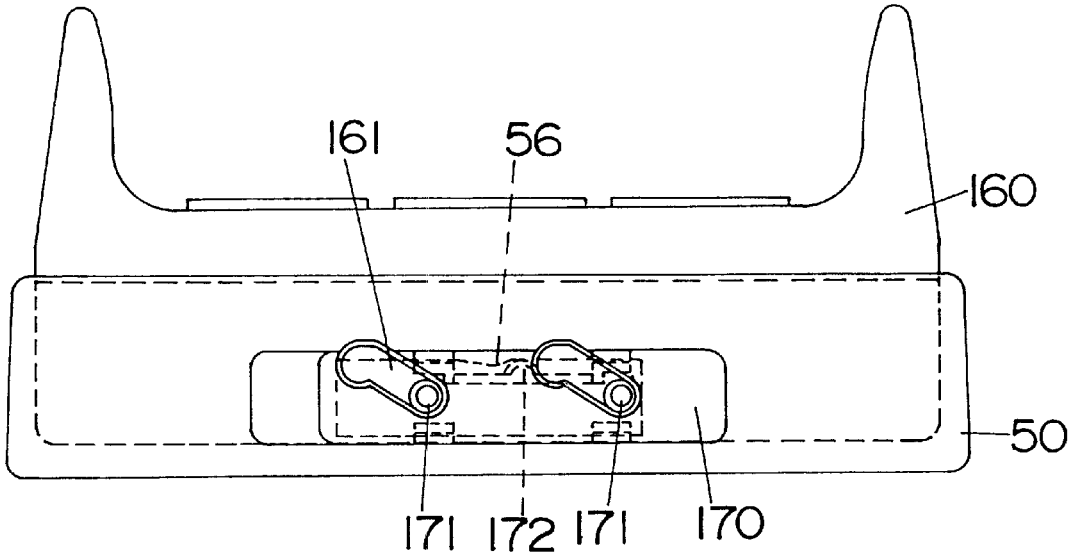
FIGS. 21A and 21B show a relation between a handle and a head frame of the cutter head respectively in the high and low positions, respectively.
Figure 21B:
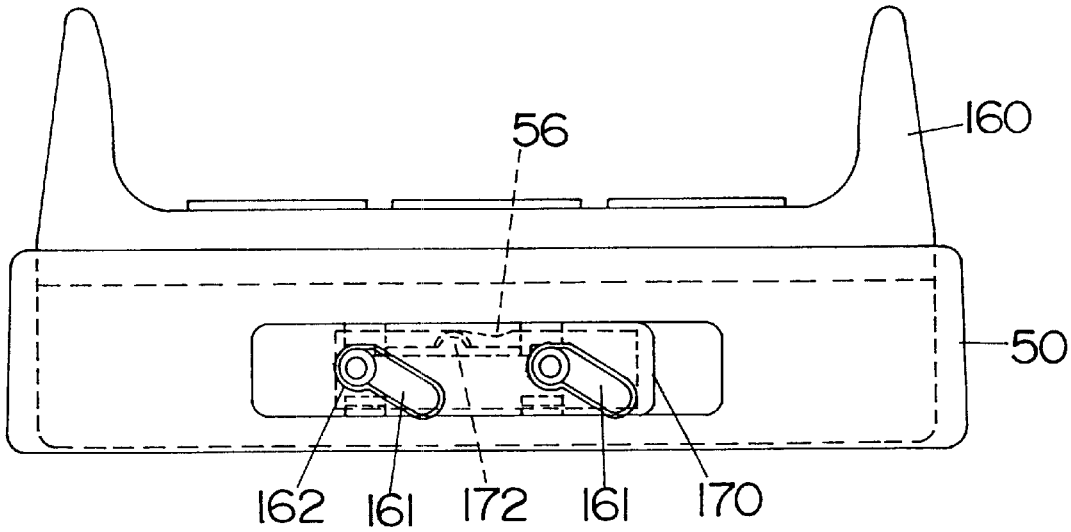

A slide handle 170 is mounted to the sleeve 50 and is connected to the support frame 160 to constitute a height adjust mechanism for varying the position of the cutter head 60C. The handle 170 is slidable on the sleeve 50 and has a pair of pins 171 projecting through a window 52 for engagement respectively into inclined slots 161 at the lower end of the support frame 160 so that the horizontal movement of the handle 170 is translated into the vertical movement of the support frame 160, i.e., the cutter head 60C. When the slide handle 170 is manipulated to move the pins 171 to the lower end of the slots 161, as shown in FIG. 21A, the support frame 160 is raised to the high position of FIG. 20A. The cutter head 60C is held stable at this position as the bias spring 44C constantly urges the outer cutter 62C upwardly. When the handle 170 is slid to move the pins 171 to the upper end of the slots 161, as shown in FIG. 21B, the support frame 160 is lowered to the low position of FIG. 20B The handle 170 travels a horizontal path which is longer than the vertical distance of the cutter head 60C between the high and low positions, thereby requiring only a gentle manipulation force for the height adjustment. The upper end of each slot 161 is designed to extend horizontally to define thereat a stop 162 for retaining the pin 171 against the bias spring 44C acting to urge the outer cutter 62C, i.e., the cutter head 60C upwardly and would otherwise moving the pins 171 down to the lower end of the slots 161. Thus, the cutter head 60C can be successfully retained at the low position.

As indicated by dotted lines in FIGS. 21A and 21B, the handle 170 is provided with a click projection 172 which cams over a dent 56 formed on the sleeve 50 during the height adjustment for giving a click resistance to the handle movement. The dent 56 has different inclines such that the handle 170 is given the click resistance which is smaller when lowering the cutter head from the high position than raising the cutter head from the low position in order that the handle 170 can be manipulated with nearly equally operating force for raising and lowering the cutter head 160. That is, the small click resistance is additive to the upward force by the bias spring when lowering the cutter head, while the large click resistance is reduced by the upward force of the bias spring when raising the cutter head. At any one of the high and low positions, the outer cutter 62C can be depressed together with the cutter holder 63C relative to the head frame 70C against the bias spring 44C for constant contact of the outer cutters with the user's skin.

As described in the above, all the parts forming the height adjust mechanism are supported to the sleeve 50 which is detachable from the housing 10C, the housing 10C can be designed to have a water-tight sealed structure without taking the height adjust mechanism into consideration. In other words, the moving parts necessary for the height adjust mechanism can be disposed completely exteriorly of the water-tight sealed housing 10C, leaving the housing free from an otherwise complicated water-tight seal.

Also in this embodiment, the support frame 160 is configured to overlap the periphery of the mount frame 30C to form a barrier which surrounds the top end of the housing where the sheared hairs are accumulated and therefore prevents the scattering of the sheared hairs outwardly of the shaver, irrespective of the high and low positions.

In order to prevent the detachment of the support frame 160 from the sleeve 50, the support frame 160 is formed at each longitudinal end with a stopper 163 for engagement with a dent 53 formed in an interior surface of each end wall of the sleeve 50. Further, ribs 54 at each end wall of the sleeve 50 engages with a notch 164 at each end wall of the support frame 160 for limit the downward movement of the support frame relative to the sleeve 50.

What is claimed is:

1. A dry shaver comprising:

a housing having a motor;

an outer cutter mounted on top of said housing;

an inner cutter projecting on top of said housing, said inner cutter being driven by said motor to move in shearing contact with said outer cutter for cutting hairs, said inner cutter being biased upwardly by a bias spring to develop a contact pressure at which said inner cutter is pressed against said outer cutter;

a cutter holder carrying said outer cutter, a head frame movably supporting said cutter holder such that said cutter holder can be vertically movable relative to said head frame, wherein a height adjust mechanism is provided for adjusting a height of said head frame relative to said housing between a high position and a low position while compressing said spring differently to vary said contact pressure.

2. The dry shaver as set forth in claim 1, wherein said head frame has a head cover projecting above the top of said housing to surround said outer cutter in such a way that the outer cutter is exposed on said head cover;

said height adjust mechanism being interlocked with said head cover so as to move said head cover together with said head frame between said high and low positions.

3. The dry shaver as set forth in claim 1, wherein a drive element projects on top of said housing for connection with said inner cutter, said bias spring being attached by said drive element with one end of said spring retained to said drive element and with the other end of said spring being held in pressed contact against said inner cutter.

4. The dry shaver as set forth in claim 1, wherein said height adjust mechanism comprises a handle and a slider which is actuated by said handle and is connected to said head frame, said slider being supported by said housing to be vertically slidable relative to said housing, and said slider having an upper end projecting on top of said housing for detachable engagement with said head frame.

5. The dry shaver as set forth in claim 4, further including:

a latch for latching said handle into positions respectively for holding said head frame in said high and low positions, respectively.

6. The dry shaver as set forth in claim 4, wherein said housing comprises a main case and a front cover, said main case having a water-tightly sealed interior space for accommodating therein said motor and carrying a drive element extending in a watertight fashion from said motor through a top of said main case for driving connection with said inner cutter, said front cover being placed over said main case to form therebetween a compartment separated from said water-tight sealed interior space of said main case, said handle being partly disposed in said compartment and exposed on the exterior of said front cover, and said slider being movably supported to said main case outside of said water-tight sealed interior space to have its one end connected with said handle and the other end connected to said head frame.

7. The dry shaver as set forth in claim 4, wherein said handle comprises a dial which is rotatably mounted to said housing and includes a gear which is in meshing engagement with a rack formed on said slider so as to covert the rotary motion of said dial into the vertical movement of said slider.

8. The dry shaver as set forth in claim 7, wherein a click spring is provided to give a clicking resistance to said rotary motion of said dial.

9. The dry shaver as set forth in claim 4, wherein an additional motor is accommodated in said housing for driving said slider to move vertically.

10. The dry shaver as set forth in claim 4, wherein said slider is formed at its upper end with a hook for engagement with said head frame and is formed at its lower end with a joint for engagement with said handle, said handle being fixed to said housing with respect to a vertical direction in which said head frame is allowed to move, and said slider having a resilient leg connecting said hook and said joint so as to permit said head frame engaged with said hook to resiliently move in the vertical direction relative to said housing.

11. The dry shaver as set forth in claim 10, wherein a restrictor is provided to restrict an extent to which said head frame is permitted to resiliently move relative to said housing, said restrictor including a rigid guide which is actuated by said handle to move vertically together with said slider, and said rigid guide being formed with a vertically elongated slot for loosely receiving a stud formed on said slider between said hook and said resilient leg, said stud being engaged with said slot such that the stud is only allowed to move vertically in said slot.

12. The dry shaver as set forth in claim 11, wherein said slider is formed as a single piece to have said resilient leg integrally formed with said hook and said joint.

13. The dry shaver as set forth in claim 4, wherein said handle is a rotary dial supported to said housing to rotate about a rotary axis, said dial being formed with a cam groove for engagement with a cam follower projecting on said slider, and said cam groove being eccentric with respect to said rotary axis such that the rotary motion of said dial is translated into the vertical movement of said slider.

14. The dry shaver as set forth in claim 13, wherein said cam groove is an endless annular groove extending about said rotary axis.

15. The dry shaver as set forth in claim 13, wherein said cam groove has a curvature varying along its length from a minimum curvature to a maximum curvature, said cam groove being engaged with said cam follower around a portion having the minimum curvature when said slider moves said head frame around said low position.

16. The dry shaver as set forth in claim 1, wherein said housing is formed on its top with a fixed mount frame for mounting said head frame, said mount frame having a peripheral wall projecting on top of said housing in an overlapping relation with said head frame irrespective of the position of said head frame relative to said housing.

17. The dry shaver as set forth in claim 1, wherein said housing has a vertically elongated front exterior face mounting a power switch for driving said inner cutter and a dial for actuating said height adjust. mechanism to adjust the height of said head frame, said dial being located closer to said head frame than said power switch.

18. The dry shaver as set forth in claim 17, wherein said dial is located centrally of said housing with respect to a width dimension thereof.

19. The dry shaver as set forth in claim 17, wherein said dial include an indicator which indicates the height of said head frame.

20. The dry shaver as set forth in claim 1, further including:

a speed controller which varies a speed of said inner cutter in accordance with varying height of said head frame relative to said housing.

21. The dry shaver as set forth in claim 20, wherein said speed controller comprises a position sensor sensing the height of said head frame, and a current regulator which varies an electric current being supplied to said motor in accordance with an output of said position sensor.

22. The dry shaver as set forth in claim 20, wherein said housing mounts on its exterior face a dial for actuating said height adjust mechanism to adjust the height of said head frame, said dial having a first linkage connected to said head frame for varying the height of said head frame and a second linkage connected to a mechanism of sensing the height of said head frame.

23. The dry shaver as set forth in claim 20, wherein said inner cutter is driven by said motor to reciprocate relative to said outer cutter, and said speed controller varying a reciprocation amplitude of said inner cutter to thereby vary the speed of said inner cutter.

24. The dry shaver as set forth in claim 20, wherein said inner cutter is driven by said motor to rotate relative to said outer cutter, and said speed controller varying a rotation speed of said inner cutter.

25. The dry shaver as set forth in claim 1, further including:

a controller which keeps the speed of the inner cutter constant irrespective of the varying height of said head frame.

26. The dry shaver as set forth in claim 25, wherein said controller comprises a motor sensor which senses the speed of said motor for feedback control of keeping the speed of said inner cutter constant.

27. The dry shaver as set forth in claim 20, wherein said speed controller increases the speed of said inner cutter as said head frame is lowered towards said low position.

28. The dry shaver as set forth in claim 20, wherein said speed controller comprises a position sensor sensing the height of said head frame in terms of a member moving in said housing together with said head frame.

29. The dry shaver as set forth in claim 21, wherein said current regulator comprises a variable resistor.

30. The dry shaver as set forth in claim 29, wherein said variable resistor is formed as a part of a member which is interlocked with said head frame to move upwardly together therewith.

31. The dry shaver as set forth in claim 29, wherein said variable resistor is formed as a part of a dial which is mounted on an exterior of the housing for actuating said height adjust mechanism to vary the height of said head frame.

32. The dry shaver as set forth in claim 31, wherein said dial rotates about a rotary axis to vary the height of said head frame, and said variable resistor is of a rotary type having a rotary shaft which is interlocked with said dial.

33. The dry shaver as set forth in claim 1, wherein said head frame is supported to a sleeve to be vertically movable relative to said sleeve, said sleeve being detachably mounted to an upper end of said housing, said sleeve carrying said height adjust mechanism which varies the height of said head frame relative to said sleeve, said height adjust mechanism including a handle which is carried on said sleeve.

34. The dry shaver as set forth in claim 33, wherein said head frame is mounted to a support frame which is movable supported to said sleeve so as to be vertically movable together with said head frame relative to said sleeve, said head frame surrounding said outer cutter to define a head cover which projects above the top of said housing to surround said outer cutter in such a way that the outer cutter is exposed on said head cover.

35. The dry shaver as set forth in claim 34, wherein said housing is closed at its upper end with a top member and is provided with a drive element which project through said top member for driving said inner cutter, said support frame being cooperative with said sleeve to form a barrier which surrounds the entire periphery of said top member irrespective of the position of said head frame relative to said housing.

36. The dry shaver as set forth in claim 33, wherein said handle travels a path for adjusting said head frame between said high and low positions, said path being longer than a vertical distance of said head frame between said high and low positions.

37. The dray shaver as set forth in claim 33, wherein a click member is provided to give a click resistance to the movement of said handle, said click member being arranged to develop the click resistance which is smaller when lowering said head frame from said high position to said low position than raising said head frame from said low position to said high position.

38. The dry shaver as set forth in claim 34, wherein said support frame has a stopper which engages with said sleeve so as to prevent an unintentional detachment of said support frame from said sleeve.

* * * * *